US006763794B1

(12) United States Patent
Torikai et al.

(10) Patent No.: US 6,763,794 B1
(45) Date of Patent: Jul. 20, 2004

(54) VIBRATION SOUND REDUCING DEVICE, AND PROCESS FOR ASSEMBLING ELASTIC MEMBRANE IN VIBRATION SOUND REDUCING DEVICE

(75) Inventors: Terukazu Torikai, Wako (JP); Kojiro Kamata, Wako (JP); Shinichi Watanabe, Wako (JP); Motoyuki Sunaoka, Wako (JP); Masao Sakashita, Wako (JP); Noriaki Kawai, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/190,235

(22) Filed: Nov. 13, 1998

(30) Foreign Application Priority Data

Nov. 14, 1997 (JP) ..... 9-313138
Nov. 14, 1997 (JP) ..... 9-313139
Nov. 17, 1997 (JP) ..... 9-314805
Nov. 17, 1997 (JP) ..... 9-315181

(51) Int. Cl.[7] ..... F02B 75/06
(52) U.S. Cl. ..... 123/192.1
(58) Field of Search ..... 303/87; 123/192.1, 123/41.01, 41.5

(56) References Cited

U.S. PATENT DOCUMENTS

| | | | | |
|---|---|---|---|---|
| 1,466,219 A | | 8/1923 | Winans | |
| 1,867,351 A | | 7/1932 | Carpentier | |
| 2,525,994 A | | 10/1950 | Baber | |
| 3,889,841 A | | 6/1975 | Edmonds | |
| 4,930,459 A | * | 6/1990 | Coffenberry | 123/41.15 |
| 5,029,824 A | * | 7/1991 | LaBeau et al. | 267/140.13 |
| 5,649,511 A | * | 7/1997 | Nguyen | 123/198 R |
| 5,964,195 A | * | 10/1999 | Sakashita et al. | 123/192.1 |

FOREIGN PATENT DOCUMENTS

| | | |
|---|---|---|
| GB | 5005 | 1/1894 |
| GB | 2 134 974 A | 8/1984 |
| JP | 53-68814 | 6/1978 |

OTHER PUBLICATIONS

Patent Abstracts of Japan & Japanese Patent Pub. No. 58–107839.

Patent Abstracts of Japan & Japanese Patent Pub. No. 60–261959.

Patent Abstracts of Japan & Japanese Patent Pub. No. 57–102539.

* cited by examiner

*Primary Examiner*—Benjamin A. Pezzlo
(74) *Attorney, Agent, or Firm*—Arent Fox PLLC

(57) ABSTRACT

A through-bore is provided in an outer wall of a passage defining structure defining a liquid passage faced by at least a portion of a vibration generating section, and opens at its inner end into the liquid passage. A vibration absorbing device includes an occluding member mounted to the outer wall to occlude the through-bore, an elastic membrane with its one end facing the liquid passage and other end facing a space defined between the elastic membrane and the occluding member, and a retaining member mounted to the occluding member for retaining the elastic membrane between the retaining member and the occluding member. Thus, a variation in pressure of a liquid in the liquid passage which is induced by the vibration generated in the vibration generating section is absorbed by flexing of the elastic membrane, whereby an exciting force applied from the liquid to the passage defining structure is effectively reduced, and a vibration sound radiated from the passage defining structure is reduced. Moreover, it is possible to suppress the increase in weight of the passage defining structure due to the mounting of the vibration absorbing device to a small level to the utmost. In addition, it is possible to avoid reduction in the sealability due to the liquid pressure in the liquid passage or due to the deterioration of the elastic membrane, and the elastic membrane can be reliably retained between the occluding member and the retaining member to ensure a sufficient sealing.

7 Claims, 24 Drawing Sheets

VIBRATION SOUND REDUCING DEVICE, AND PROCESS FOR ASSEMBLING ELASTIC MEMBRANE IN VIBRATION SOUND REDUCING DEVICE

BACKGROUND OF THE INVENTION

1. Field of the Invention

The present invention relates to a vibration sound reducing device including a vibration absorbing means which is mounted to a passage defining structure for defining a liquid passage faced by at least a portion of a vibration generating section, and which is adapted to absorb a vibration transmitted from the vibration generating section through a liquid in the liquid passage. Particularly, the present invention relates to a vibration sound reducing device appropriately applied to a water-cooled internal combustion engine in which a cooling water passage including a water passage portion surrounding a cylinder portion as the vibration generating section is provided in an engine body.

2. Description of the Related Art

To reduce a piston slap sound caused by collision of a piston against an inner surface of the cylinder portion in a water-cooled internal combustion engine, the following techniques have been conventionally used: (1) a technique to suppress the amplitude of vibration to a small level by increasing the thickness of the cylinder portion; and (2) a technique to suppress the amplitude of vibration to a small level by increasing the thickness of an outer wall of a cylinder block.

Known structures for suppressing the vibration of non-compressable cooling water existing in a cooling water passage, include, for example, (3) a structure in which a sound shielding layer is provided outside the cooling water passage in the cylinder block with a partition wall interposed therebetween, as disclosed in Japanese Utility Model Application Laid-open No. 53-68814.

In the techniques (1) and (2), however, the weight of the engine body is increased due to the increase in thickness of the cylinder portion and the cylinder block. The structure (3) is a double, structure in which the cooling water passage and the sound layer are disposed through the partition wall interposed therebetween. Therefore, the structure (3) is complicated and is difficult to manufacture, resulting in an increased manufacture cost, and bringing about an increase in weight of the engine body.

Therefore, the present assignee has already proposed a vibration sound reducing device for a water-cooled internal combustion engine in Japanese Patent Application No. 8-351288, comprising a vibration absorbing means which is mounted to an outer wall of an engine body so as to occlude a through-bore that is provided in the outer wall of the engine body while facing a cooling water passage, the vibration absorbing means including an elastic membrane with one surface thereof facing the cooling water passage and with the other surface thereof facing a space.

With this proposed technique, a variation in pressure of the cooling water is absorbed by flexing of the elastic membrane with one surface thereof facing the cooling water passage. Thus, an exciting force applied from the cooling water to the outer wall of the engine body can be effectively reduced, and the piston slap sound radiated from the engine body can be reduced without an increase in weight of the engine body.

In the above proposed technique, however, a peripheral edge of the elastic membrane is secured by baking or the like to a member that is mounted to the engine body so as to occlude the through-bore. In such a structure in which the elastic membrane is fixed, it is difficult to ensure the satisfactory sealing between the cooling water passage and the space due to the water pressure in the cooling water passage or due to the deterioration of the elastic membrane. It is also considered that the peripheral edge of the elastic membrane is adhered to the member mounted to the engine body, but even in this case, it is difficult to ensure the satisfactory sealing property.

SUMMARY OF THE INVENTION

Accordingly, it is an object of the present invention to provide a vibration sound reducing device, wherein the vibration sound such as the piston slap sound can be effectively reduced in a simple structure which brings about no increase in weight of the passage defining structure and moreover, the satisfactory sealing can be ensured.

To achieve the above object, according to a first aspect and feature of the present invention, there is provided a vibration sound reducing device comprising a vibration absorbing means which is mounted to a passage defining structure defining a liquid passage faced by at least a portion of a vibration generating section, the vibration absorbing means absorbing the vibration transmitted from the vibration generating section through a liquid in the liquid passage, wherein the vibration absorbing means comprises an occluding member mounted to an outer wall of the passage defining structure so as to occlude a through-bore which is provided in the outer wall of the passage defining structure and opens at an inner end thereof into the liquid passage, an elastic membrane with one of opposite surfaces thereof facing the liquid passage and with the other surface thereof facing a space defined between the elastic membrane and the occluding member, and a retaining member mounted to the occluding member for retaining the elastic membrane between the retaining member and the occluding member.

With such arrangement of the first feature, the vibration generated in the vibration generating section induces the vibration of the liquid in the liquid passage, but a variation in pressure of the liquid is absorbed by flexing of the elastic membrane with its one surface facing the liquid passage. Thus, the exciting force applied from the liquid to the passage defining structure is effectively reduced, and the vibration sound radiated from the passage defining structure is reduced. Moreover, the vibration absorbing means is mounted to a portion of the outer wall of the passage defining structure and hence, the increase in weight of the passage defining structure due to the mounting of the vibration absorbing means can be suppressed to a small level to the utmost. In addition, the elastic membrane is retained between the occluding member and the retaining member. Therefore, it is possible to avoid that the sealability is reduced due to the liquid pressure in the liquid passage or due to the deterioration of the elastic membrane, whereby the elastic membrane can be reliably retained between the occluding member and the retaining member. As compared with a vibration absorbing means including an elastic membrane secured directly to an occluding member by baking or adhesion, the sufficient sealability can be ensured.

According to a second aspect and feature of the present invention, in addition to the arrangement of the first feature, the occluding member has a cylindrical mounting portion projectingly provided at an inner end thereof; the elastic membrane includes an endless sealing portion which is in contact with a tip end face of the mounting portion, and a membrane portion formed at a thickness smaller than that of the sealing portion and integrally connected to an inner periphery of the sealing portion with a step formed therebetween; and the retaining member mounted to the occluding member with the sealing portion sandwiched between the retaining member and the tip end of the mounting portion is provided with a positioning portion which is engaged with the inner periphery of the sealing portion to position the elastic membrane in a plane perpendicular to an axis of the mounting portion. With such arrangement of the second feature, the sealing portion of the elastic membrane is accurately positioned and sandwiched between the mounting portion and the retaining member, whereby the sealability can be more sufficiently ensured to enhance the vibration absorbing characteristic.

According to a third aspect and feature of the present invention, in addition to the arrangement of the first feature, the occluding member has a cylindrical mounting portion projectingly provided at an inner end thereof; the elastic membrane includes an endless sealing portion which is in contact with a tip end face of the mounting portion, and an annular lip portion protruding outwards from an outer periphery of the sealing portion; and the retaining member mounted to the occluding member with the sealing portion sandwiched between the retaining member and the tip end of the mounting portion is provided with a cylindrical portion which comes into contact with the outer periphery of the lip portion to position the elastic membrane in a plane perpendicular to an axis of the mounting portion. With such arrangement of the third feature, the sealing portion of the elastic membrane is accurately positioned and sandwiched between the mounting portion and the retaining member, whereby the sealability can be more sufficiently ensured to enhance the vibration absorbing characteristic. Moreover, a flash produced on the outer periphery of the elastic membrane upon formation of the elastic membrane by molding can be effectively utilized as the lip portion, and hence, a flash removing operation after formation of the elastic membrane is not required.

According to a fourth aspect and feature of the present invention, in addition to the arrangement of the first feature, the retaining member is press-fitted over the occluding member with an outer periphery of the elastic membrane sandwiched between the retaining member and the occluding member, and the occluding member is provided with a limiting portion for limiting an end of movement of the retaining member in a direction of press-fitting over the occluding member. With such arrangement of the fourth feature, it is possible to reliably retain the elastic membrane on the occluding member. In addition, since the retaining member may be press-fitted, until the press-fitting of the retaining member is limited by the limiting portion, the sealability of the elastic membrane can be sufficiently ensured, while enhancing the press-fitting operability.

According to a fifth aspect and feature of the present invention, in addition to the arrangement of the first feature, the occluding member is provided with an annular engage portion which is engaged with the elastic membrane over an entire periphery of the elastic membrane to position the elastic membrane in a plane perpendicular to an axis of the through-bore. With such arrangement of the fifth feature, the sealing portion of the elastic membrane is accurately positioned and sandwiched between the mounting portion and the retaining member, whereby the sealability can be more sufficiently ensured to enhance the vibration absorbing characteristic.

According to a sixth aspect and feature of the present invention, in addition to the arrangement of the first feature, the vibration generating section is a cylinder portion which is provided in a cylinder block in a water-cooled internal combustion engine, said cylinder portion having a piston slidably received therein, and the passage defining structure including the cylinder block is an engine body which is provided with (1) a cooling water passage defined as the liquid passage including a water passage portion surrounding the cylinder portion, and (2) the vibration absorbing means for absorbing the vibration transmitted from the cylinder portion through the cooling water in the cooling water passage. With such arrangement of the sixth feature, the vibration of the cylinders caused by collision of the piston against an inner surface of each of the cylinders induces the vibration of the cooling water in the cooling water passage. However, a variation in pressure of the cooling water is absorbed by flexing of the elastic membrane with its one surface facing the cooling water passage. Therefore, an exciting force applied from the cooling water to the outer wall of the engine body is effectively reduced, and a piston slap sound radiated from the engine body is reduced. Moreover, since the vibration absorbing means is mounted to a portion of the outer wall of the engine body, the increase in weight of the engine body due to the mounting of the vibration absorbing means can be suppressed to a small level to the utmost.

According to a seventh aspect and feature of the present invention, there is provided a vibration reducing device comprising a vibration absorbing means which is mounted in a passage defining structure defining a liquid passage faced by at least a portion of a vibration generating section, the vibration absorbing means absorbing the vibration transmitted from the vibration generating section through a liquid in the liquid passage, wherein the vibration absorbing means comprises an occluding member which is mounted to an outer wall of the passage defining structure so as to occlude a through-bore which is provided in the outer wall and opens at an inner end thereof into the liquid passage, and an elastic membrane press-fitted over and fixed to the occluding member with one of opposite surface thereof facing the liquid passage and the other surface thereof facing a space defined between the elastic membrane and the occluding member.

With such arrangement of the seventh feature, the vibration generated in the vibration generating section induces the vibration of the liquid in the liquid passage. However, a variation in pressure of the cooling water is absorbed by flexing of the elastic membrane with its one surface facing the cooling water passage. Therefore, an exciting force applied from the liquid to the passage defining structure is effectively reduced, and a piston slap sound radiated from the passage defining structure is reduced. Moreover, since the vibration absorbing means is mounted to a portion of the outer wall of the engine body, the increase in weight of the passage defining structure due to the mounting of the vibration absorbing means can be suppressed to a small level to the utmost. In addition, the elastic membrane is press-fitted over and fixed to the occluding member. Therefore, it is possible to avoid that the sealability is reduced due to the liquid pressure in the liquid passage or due to the deterioration of the elastic membrane, thereby reliably maintaining the fixed state of the elastic membrane to the occluding member. As compared with the vibration absorbing means including the elastic membrane secured to the occluding member by baking or adhesion, the sufficient sealability can be ensured.

According to an eighth aspect and feature of the present invention, in addition to the arrangement of the seventh feature, the occluding member has a cylindrical mounting portion projectingly provided at an inner end thereof, and the elastic membrane includes a cylindrical sealing portion press-fitted over an outer periphery of the mounting portion, and a membrane portion connected to an end of the sealing portion to define a space between the membrane portion and the occluding member, the sealing portion being provided with a ring-shaped reinforcing member. With such arrangement of the eighth feature, during press-fitting of the elastic membrane over the occluding member, the cylindrical shape of the sealing portion can be maintained by reinforcing the sealing portion of the elastic membrane, i.e., a portion press-fitted over the occluding member with the reinforcing member, thereby facilitating the press-fitting operation, and reliably maintaining the close contact of the sealing portion with the outer periphery of the mounting portion to enhance the sealability.

According to a ninth aspect and feature of the present invention, in addition to the arrangement of the eighth feature, the reinforcing member is mounted within the sealing portion in such a manner that the reinforcing member is entirely wrapped with the sealing portion. With such arrangement, it is possible to reliably prevent the reinforcing member from being fallen from the elastic membrane.

According to a tenth aspect and feature of the present invention, in addition to the arrangement of the eighth feature, the elastic membrane is provided with a slip-off preventing portion which is resiliently engaged with the occluding member for inhibiting the elastic membrane from falling off the occluding member. Thus, it is possible to reliably maintain the press-fitted and fixed state of the elastic membrane to the occluding member.

According to an eleventh aspect and feature of the present invention, in addition to the arrangement of the seventh feature, a sealing portion of the elastic membrane is provided with a slip-off preventing portion which is resiliently engaged with a mounting portion of the occluding member for inhibiting the elastic membrane from falling off the mounting portion, the slip-off preventing portion being located inside the reinforcing member. Thus, it is possible to firmly maintain the engagement of the slip-off preventing portion with the mounting portion by the reinforcing member.

According to a twelfth aspect and feature of the present invention, in addition to the arrangement of the seventh feature, the occluding member has a cylindrical mounting portion projectingly provided at an inner end thereof, and the elastic membrane includes a cylindrical sealing portion press-fitted over an outer periphery of the mounting portion, and a membrane portion connected to an end of the sealing portion to define a space between the membrane portion and the occluding member, the thickness of the sealing portion being set larger than that of the membrane portion. Thus, the rigidity of the sealing portion can be increased to a relatively high level by forming the sealing portion at the relatively large thickness, thereby firmly maintaining the press-fitted state of the sealing portion over the mounting portion.

According to a thirteenth aspect and feature of the present invention, in addition to the arrangement of the seventh feature, the vibration generating section is a cylinder portion which is provided in a cylinder block in a water-cooled internal combustion engine, the cylinder portion having a piston slidably received therein, and the passage defining structure including the cylinder block is an engine body which is provided with (1) a cooling water passage defined as the liquid passage including a water passage portion surrounding the cylinder portion, and (2) the vibration absorbing means for absorbing the vibration transmitted from the cylinder portion through the cooling water in the cooling water passage.

With such arrangement of the thirteenth feature, the vibration of the cylinders caused by collision of the piston against an inner surface of each of the cylinders induces the vibration of the cooling water in the cooling water passage. However, a variation in pressure of the cooling water is absorbed by flexing of the elastic membrane with its one surface facing the cooling water passage. Therefore, an exciting force applied from the cooling water to the outer wall of the engine body is effectively reduced, and a piston slap sound radiated from the engine body is reduced. Moreover, since the vibration absorbing means is mounted to a portion of the outer wall of the engine body, the increase in weight of the engine body due to the mounting of the vibration absorbing means can be suppressed to a small level to the utmost.

According to a fourteenth aspect and feature of the present invention, there is provided a vibration sound reducing device comprising a vibration absorbing means which is mounted in a passage defining structure defining a liquid passage faced by at least a portion of a vibration generating section, the vibration absorbing means absorbing the vibration transmitted from the vibration generating section through a liquid in the liquid passage, wherein the passage defining structure is provided at an outer wall thereof with a through-bore which opens at an inner end thereof into the liquid passage, and a collar-shaped receiving portion protruding radially inwards from an inner surface of the through-bore, and the vibration absorbing means comprises an occluding member mounted to the outer wall to occlude the through-bore, and an elastic membrane having an outer periphery clamped between the receiving portion and the occluding member with one of opposite surfaces thereof facing the liquid passage and the other surface thereof facing a space defined between the elastic membrane and the occluding member.

With such arrangement of the fourteen feature, the vibration generated in the vibration generating section induces the vibration of the liquid in the liquid passage. However, a variation in pressure of the liquid is absorbed by flexing of the elastic membrane with its one surface facing the liquid passage. Therefore, an exciting force applied from the liquid to the outer wall of the passage defining structure is effectively reduced, and a vibration sound radiated from the passage defining structure is reduced. Moreover, since the vibration absorbing means is mounted to a portion of the outer wall of the passage defining structure, the increase in weight of the passage defining structure due to the mounting of the vibration absorbing means can be suppressed to a small level to the utmost. In addition, the elastic membrane is clamped between the receiving portion provided at the outer wall of the passage defining structure and the occluding member, and hence, it is possible to avoid that the sealability is reduced due to the liquid pressure in the liquid passage or due to the deterioration of the elastic membrane, thereby reliably clamping the elastic membrane between the occluding member and the receiving portion. As compared with the vibration absorbing means including the elastic membrane secured directly to the occluding member by baking or adhesion, the sufficient sealability can be ensured. Further, the flowing of the liquid in the liquid passage can be prevented from being hindered, by providing the elastic membrane, so that it does not protrudes into the liquid passage. In addition, since the space cannot be surrounded by the liquid in the liquid passage, it is possible avoid that the vibration characteristic is changed due to a variation in temperature of the liquid, whereby the vibration characteristic is stabilized.

According to a fifteenth aspect and feature of the present invention, in addition to the arrangement of the fourteenth feature, the outer wall of the passage defining structure is integrally provided with a cylindrical boss portion having the through-bore; the outer periphery of the elastic membrane clamped between the receiving portion and the occluding member is provided with a protruding annular lip which is in close contact with the receiving portion of the occluding member; and the occluding member is integrally provided with a limiting collar portion which is in contact with an outer end of the boss portion to limit an end of movement of the occluding member in a direction toward the receiving portion. With such arrangement of the fifteenth feature, the sealability can be enhanced by crushing the lip, and the crushing margin of the lip can be set at a preset value by the abutment of the limiting collar portion against the outer end of the boss portion. It is not necessary to attach the occluding member to the outer wall, while taking the margin of crushing of the lip into consideration, thereby enhancing the assemblability.

According to a sixteenth aspect and feature of the present invention, in addition to the arrangement of the fourteenth feature, the outer periphery of the elastic membrane is provided with an engage portion which is engaged with the occluding member. With such arrangement of the sixteenth feature, it is possible not only to reliably prevent the elastic membrane from falling from between the receiving portion and the occluding member, but also to mount the vibration absorbing means to the outer wall of the passage defining structure in a state in which the elastic membrane is mounted to the occluding member, and hence, the assembling operation is facilitated.

According to a seventeenth aspect and feature of the present invention, in addition to the arrangement of the sixteenth feature, the occluding member is provided with a cylindrical portion which clamps the outer periphery of the elastic membrane between the cylindrical portion and the receiving portion, and the outer periphery of the elastic membrane is integrally provided with an engage portion which is formed into a cylindrical shape, so that the engage portion is resiliently fitted into an annular recess which is provided in an outer periphery of a tip end of the cylindrical portion in the annular recess having a tapered shape with its diameter reduced toward the receiving portion. With such arrangement of the seventeenth feature, the cylindrical portion of the occluding member can be fitted to the engage portion, while avoiding a damage to the elastic membrane, thereby facilitating the mounting of the elastic membrane to the occluding member. Moreover, in a state in which the cylindrical portion is fitted to the engage portion, the elastic membrane exhibits a resilient force for bringing the inner surface of the engage portion into close contact with the annular recess and hence, the inner surface of the engage portion can be brought into close contact with the entire surface of the annular recess to further enhance the sealing property.

According to a eighteenth aspect and feature of the present invention, in addition to the arrangement of the fourteenth feature, the vibration generating section is a cylinder portion which is provided in cylinder block in a water-cooled internal combustion engine, the cylinder portion having a piston slidably received therein; the passage defining structure is an engine body which includes the cylinder block and which is provided with a cooling water passage defined as the liquid passage including a water passage portion surrounding the cylinder portions; and the vibration absorbing means is mounted to the outer wall of the engine body for absorbing the vibration transmitted from the cylinder portions through the cooling water in the cooling water passage. With such arrangement of the eighteenth feature, the vibration of each of the cylinders caused by collision of the piston against the inner surface of the cylinder induces the vibration of the cooling water in the cooling water passage, but a variation in pressure of the cooling water is absorbed by flexing of the elastic membrane with its one surface facing the cooling water passage. Therefore, the exciting force applied from the cooling water to the outer wall of the engine body is effectively reduced, and a piston slap sound radiated from the engine body is reduced. Moreover, the vibration absorbing means is mounted to a portion of the outer wall of the engine body and hence, the increase in weight of the engine body due to the mounting of the vibration absorbing means can be suppressed to a small level to the utmost.

According to a nineteenth aspect and feature of the present invention, there is provided a vibration sound reducing device comprising a vibration absorbing means which is mounted to a passage defining structure defining a liquid passage faced by at least a portion of a vibration generating section, the vibration absorbing means absorbing the vibration transmitted from the vibration generating section through a liquid in the liquid passage, wherein the vibration absorbing means comprises an occluding member mounted to an outer wall of the passage defining structure so as to occlude a through-bore which is provided in the outer wall of the passage defining structure and opens at an inner end thereof into the liquid passage, and an elastic membrane mounted to the occluding member with opposite surfaces thereof facing the liquid passage and a space defined between the elastic membrane and the occluding member, the elastic membrane being of such a shape that it is curved toward the occluding member, immediately before it comes into contact with at least the occluding member, when the elastic membrane is mounted to the occluding member.

With such arrangement of the nineteenth feature, the vibration generated in the vibration generating section induces the vibration of the liquid in the liquid passage, but a variation in pressure of the liquid is absorbed by flexing of the elastic membrane with its one surface facing the liquid passage. Thus, the exciting force applied from the liquid to the passage defining structure is effectively reduced, and the vibration sound radiated from the passage defining structure is reduced. Moreover, the vibration absorbing means is mounted to a portion of the outer wall of the passage defining structure and hence, the increase in weight of the passage defining structure due to the mounting of the vibration absorbing means can be suppressed to a small level to the utmost. There is a possibility that the elastic membrane may be expanded toward the liquid defining structure due to an increase in pressure in the space defined between the elastic membrane and the occluding member, when the elastic membrane is mounted to the occluding member, thereby changing the vibration characteristic of the elastic membrane to reduce the vibration absorbing effect. There is also a possibility that the flowing of the liquid in the liquid passage may be hindered, when the elastic membrane is expanded in a large amount toward the liquid defining passage. However, since the elastic membrane is of the shape such that it is curved toward the occluding member, immediately before it comes into a contact with at least the occluding member, when the elastic membrane is mounted to the occluding member, it is possible to avoid that the elastic membrane is expanded toward the liquid defining passage by the mounting of the elastic membrane to the occluding member, and to provide an excellent vibration absorbing effect. Additionally, the flowing of the liquid in the liquid passage cannot be hindered.

According to a twentieth aspect and feature of the present invention, in addition to the arrangement of the nineteenth feature, the occluding member has a cylindrical mounting portion projectingly provided at an inner end thereof and the elastic membrane is formed into a cap-shape and comprises a cylindrical sealing portion fitted over and fixed to an outer periphery of the mounting portion, and a membrane portion connected to an end of the sealing portion while defining a space between the membrane portion and the occluding member. With such arrangement of the twentieth feature, by fitting and fixing the sealing portion to the cylindrical mounting portion, the mounting of the elastic membrane to the occluding member can be facilitated, and the area of contact between the elastic membrane and the occluding member can be increased to enhance the sealability between the elastic membrane and the occluding member. Moreover, at a time point when a tip end of the sealing portion is fitted over the mounting portion of the occluding member upon the mounting of the elastic membrane to the occluding member, the space is brought into a closed state. As the degree of fitting of the sealing portion over the mounting portion is increased, the pressure in the space is largely increased. However, since the elastic membrane is of the shape such that it is curved toward the occluding member before mounting of the elastic membrane to the occluding member, it is possible to further effectively prevent the elastic membrane from being expanded toward the liquid passage by the mounting the elastic membrane to the occluding member, notwithstanding that the pressure in the space is largely increased.

According to a twenty-first aspect and feature of the present invention, in addition to the arrangement of the nineteenth feature, the elastic membrane is formed into a shape such that it is expanded toward the occluding member in a natural state with no external force applied thereto. With such arrangement of the twenty-first feature, it is possible to prevent the elastic membrane from being expanded toward the liquid passage by the mounting of the elastic membrane to the occluding member without application of any operation when the elastic membrane is mounted to the occluding member.

According to a twenty-second aspect and feature of the present invention, in addition to the arrangement of the nineteenth feature, the elastic membrane is assembled to the occluding member in a state in which the elastic membrane is urged by an urging member, so that it is curved toward the occluding member. With such arrangement of the twenty-second feature, since the elastic membrane is assembled to the occluding member in the state in which the elastic membrane is forcibly curved toward the space, it is possible to avoid that the pressure in the space is largely increased, by eliminating air at that portion of the elastic membrane which is curved toward the space.

According to a twenty-third aspect and feature of the present invention, there is provided a vibration sound reducing device comprising a vibration absorbing means which is mounted to a passage defining structure defining a liquid passage faced by at least a portion of a vibration generating section, the vibration absorbing means absorbing the vibration transmitted from the vibration generating section through a liquid in the liquid passage, wherein the passage defining structure is provided at an outer wall thereof with a mounting bore which opens at its inner end into the liquid passage, and the vibration absorbing means comprises an occluding member mounted to occlude the mounting bore and including a cylindrical support tube portion having external threads provided around an outer periphery thereof and threadedly engaged with internal threads provided on an inner surface of the mounting bore, and an elastic membrane mounted to an inner end of the occluding member with one of opposite surfaces thereof facing the liquid passage and the other surface thereof facing a space defined between the elastic membrane and the occluding member, the occluding member being provided with a tool-engaging bottomed bore which opens into an outer end of the occluding member, the tool-engaging bore being defined to have an axially extending portion disposed in the support tube portion within an axial region where the external threads are disposed.

With such arrangement of the twenty-third feature, the vibration generated in the vibration generating section induces the vibration of the liquid in the liquid passage, but a variation in pressure of the liquid is absorbed by flexing of the elastic membrane with its one surface facing the liquid passage. Thus, the exciting force applied from the liquid to the passage defining structure is effectively reduced, and the vibration sound radiated from the passage defining structure is reduced. Moreover, the vibration absorbing means is mounted to a portion of the outer wall of the passage defining structure and hence, the increase in weight of the passage defining structure due to the mounting of the vibration absorbing means can be suppressed to a small level to the utmost. In addition, since the occluding member is provided with the tool-engaging bore which opens into the outer end thereof, the occluding member can be screwed into the mounting bore by bringing a tool into engagement into the tool-engaging bore to turning the occluding member. Moreover, since the axially extending portion of the tool-engaging bore is disposed within the axial region where the external threads are disposed, it is possible to avoid, to the utmost, that the portion for engagement of the tool is disposed at a location axially offset from the support tube portion, thereby making the occluding member compact, and reducing the weight of the occluding member by an amount corresponding to the provision of the tool-engaging bore.

According to a twenty-fourth aspect and feature of the present invention, there is provided a vibration sound reducing device comprising a vibration absorbing means which is mounted to a passage defining structure defining a liquid passage faced by at least a portion of a vibration generating section, the vibration absorbing means absorbing the vibration transmitted from the vibration generating section through a liquid in the liquid passage, wherein an outer wall of the passage defining structure is provided with a mounting bore which opens at an inner end thereof into the liquid passage, and the vibration absorbing means comprises an occluding member which is mounted to occlude the mounting bore and which includes a cylindrical support tube portion having external threads provided around an outer periphery thereof and threadedly engaged with internal threads provided on an inner surface of the mounting bore, and an elastic membrane mounted to an inner end of the occluding member with one of opposite surfaces thereof facing the liquid passage and the other surface thereof facing a space defined between the elastic membrane and the occluding member, the occluding member being provided with a recess which opens into an inner end of the occluding member to define the space, an axially extending portion of the recess being disposed in the support tube portion within an axial region where the external threads are disposed.

With such arrangement of the twenty-fourth feature, the vibration generated in the vibration generating section induces the vibration of the liquid in the liquid passage, but a variation in pressure of the liquid is absorbed by flexing of the elastic membrane with its one surface facing the liquid passage. Thus, the exciting force applied from the liquid to the passage defining structure is effectively reduced, and the vibration sound radiated from the passage defining structure is reduced. Moreover, the vibration absorbing means is mounted to a portion of the outer wall of the passage defining structure and hence, the increase in weight of the passage defining structure due to the mounting of the vibration absorbing means can be suppressed to a small level to the utmost. In addition, the occluding member is provided with the recess opening into the inner end of the occluding member in order to define the space, and the volume of the space can be sufficiently ensured by the recess. Moreover, since the axially extending portion of the recess is disposed in the support tube portion within the axial region where the external threads, it is possible to avoid, to the utmost, that the portion for defining the space is disposed at a location axially offset from the support tube portion, thereby making the occluding member compact and reducing the weight of the occluding member by an amount corresponding to the provision of the recess.

According to a twenty-fifth aspect and feature of the present invention, there is provided a vibration sound reducing device comprising a vibration absorbing means which is mounted to a passage defining structure defining a liquid passage faced by at least a portion of a vibration generating section, the vibration absorbing means absorbing the vibration transmitted from the vibration generating section through a liquid in the liquid passage, wherein an outer wall of the passage defining structure is provided with a mounting bore which opens at an inner end thereof into the liquid passage, and the vibration absorbing means comprises an occluding member which is mounted to occlude the mounting bore and which includes a cylindrical support tube portion having external threads provided around an outer periphery thereof and threadedly engaged with internal threads provided on an inner surface of the mounting bore, and an elastic membrane mounted to an inner end of the occluding member with one of opposite surfaces thereof facing the liquid passage and the other surface thereof facing a space defined between the elastic membrane and the occluding member, the occluding member being provided with a tool-engaging bottomed bore which opens into an outer end of the occluding member, a recess which opens into an inner end of the occluding member to define the space, and a partition wall whose outer periphery is connected to an inner periphery of the support tube portion in a plane perpendicular to an axis of the mounting bore, the partition wall partitioning the tool-engaging bore and the recess from each other, opposite surfaces of the partition wall respectively defining a closed end of the tool-engaging bore and a closed end of the recess and being disposed on the support tube portion within an axial region where the external threads are disposed.

With such arrangement of the twenty-fifth feature, the vibration generated in the vibration generating section induces the vibration of the liquid in the liquid passage, but a variation in pressure of the liquid is absorbed by flexing of the elastic membrane with its one surface facing the liquid passage. Thus, the exciting force applied from the liquid to the passage defining structure is effectively reduced, and the vibration sound radiated from the passage defining structure is reduced. Moreover, the vibration absorbing means is mounted to a portion of the outer wall of the passage defining structure and hence, the increase in weight of the passage defining structure due to the mounting of the vibration absorbing means can be suppressed to a small level to the utmost. In addition, the occluding member is provided with the tool-engaging bore which opens into the outer end of the occluding member, and the recess which opens into the inner end of the occluding member in order to define the space. Thus, the occluding member can be screwed into the mounting bore by bringing a tool into engagement into the tool-engaging bore and turning the occluding member, and the volume of the space can be sufficiently ensured by the recess. Moreover, since the opposite surfaces of the partition wall defining the closed end of the tool-engaging bore and the closed end of the recess respectively are disposed on the support tube portion within the axial region where the external threads are disposed, portions of the tool-engaging bore and the recess are disposed within the axial threads are disposed. Thus, it is possible to avoid, to the utmost, that the tool-engaging bore and the recess are disposed at locations axially offset from the support tube portion, thereby making the occluding member compact, and further reducing the weight of the occluding member by an amount corresponding to the provision of the tool-engaging bore and the recess. Further, the rigidity of the support tube portion screwed into the mounting bore can be enhanced due to the outer periphery of the partition wall being connected to the inner periphery of the support tube portion.

According to a twenty-sixth aspect and feature of the present invention, in addition to the arrangement of the twenty-fifth feature, the partition wall is disposed at a central portion of the support tube portion within the axial region where the external threads are disposed. With such arrangement of the twenty-sixth feature, the rigidity of the support tube portion screwed into the mounting bore can be further enhanced.

The above and other objects, features and advantages of the invention will become apparent from the following description of the preferred embodiment taken in conjunction with the accompanying drawings.

BRIEF DESCRIPTION OF THE DRAWINGS

FIGS. 1 to 5 show a first embodiment of the present invention, wherein

FIG. 1 is a perspective view of a cylinder block in a 4-cylidner water-cooled internal combustion engine;

FIG. 2 is an enlarged sectional view taken along a line 2—2 in FIG. 1;

FIG. 3 is an enlarged view of an essential portion shown in FIG. 2;

FIG. 4 is a diagram showing a vibration mode of an outer wall surface of the cylinder block in a direction of an arrangement of cylinder portions;

FIG. 5 is a diagram showing the vibration acceleration characteristic relative to the frequency in contradistinction to that in the prior art;

FIGS. 13 and 14 show a ninth embodiment of the present invention, wherein FIG. 13 is a sectional view similar to FIG. 3, but according to the ninth embodiment;

FIG. 14 is a sectional view showing a state before press-fitting of an elastic membrane over an occluding member;

FIGS. 15 and 16 show a tenth embodiment of the present invention, wherein FIG. 15 is a vertical sectional view showing a state with no external force applied to an elastic membrane before being press-fitted over an occluding member;

FIG. 16 is a vertical sectional view showing a state with an urging force applied to the elastic membrane by an urging member before press-fitting of the elastic membrane over the occluding member;

FIGS. 25 and 26 show a nineteenth embodiment of the present invention, wherein FIG. 25 is a sectional view similar to FIG. 3; and FIG. 26 is a sectional view similar to FIG. 25, but in a state before mounting of an occluding member.

DETAILED DESCRIPTION OF THE PREFERRED EMBODIMENT

Figure 1:
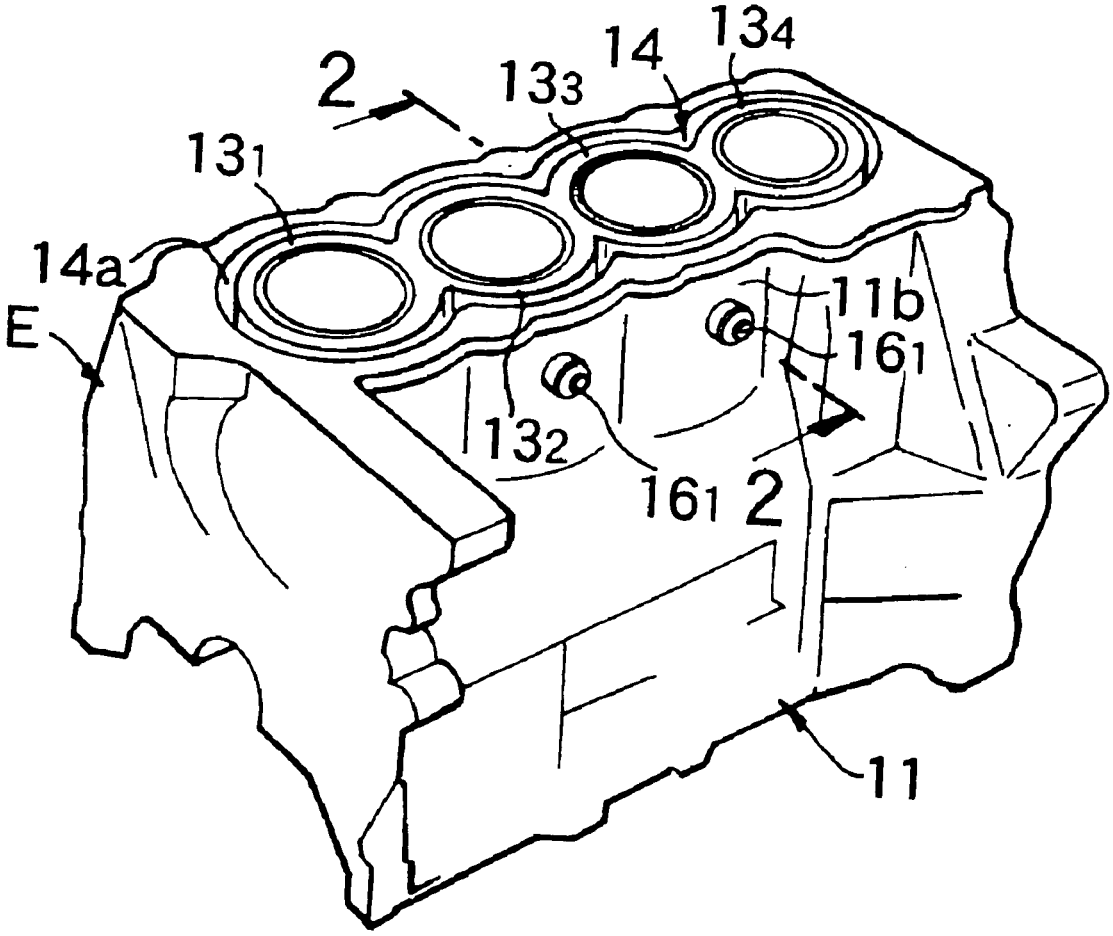
Figure 2:
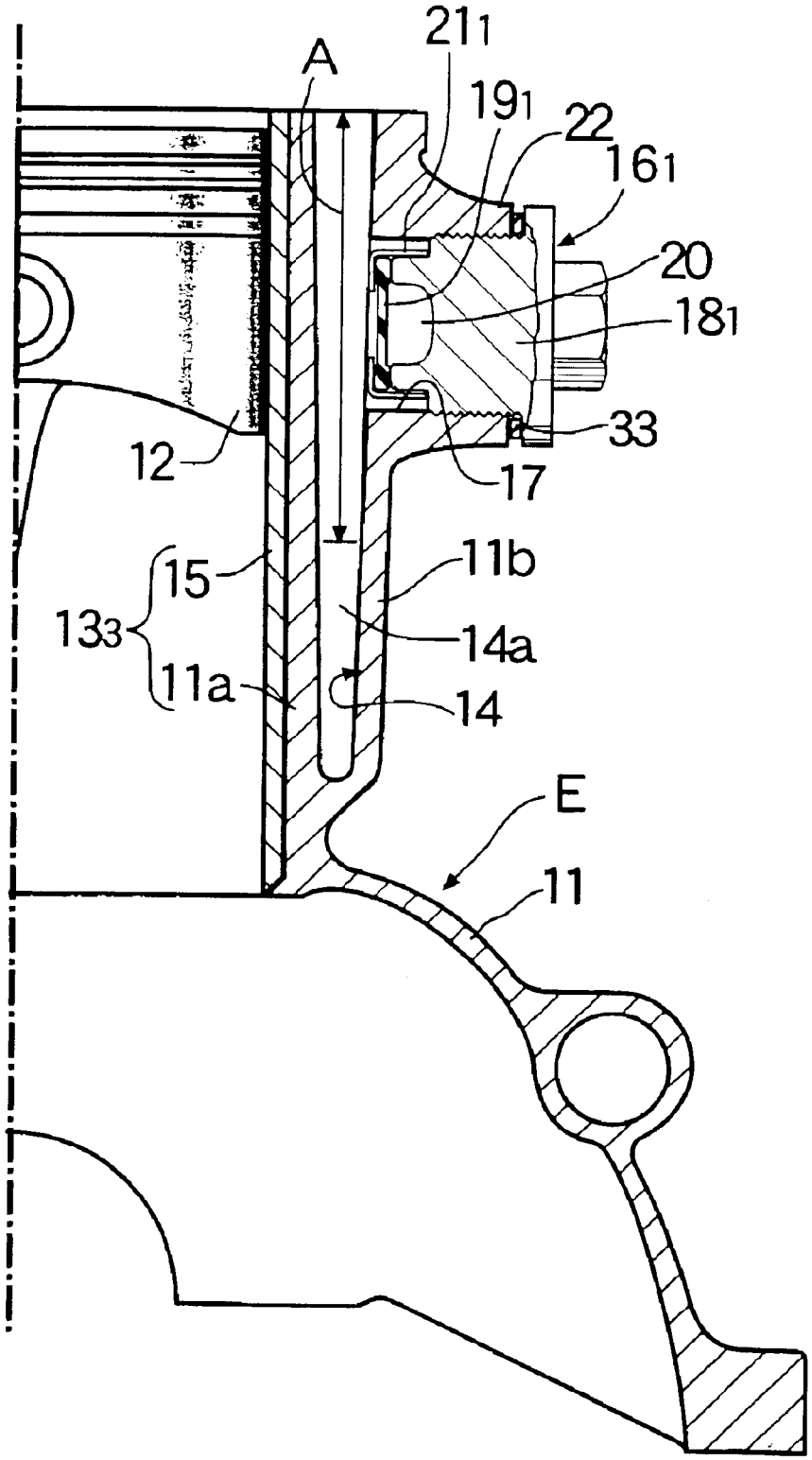

A first embodiment of the present invention will now be described with reference to FIGS. 1 to 5. Referring first to FIGS. 1 and 2, a cylinder block 11 in a water-cooled 4-cylinder internal combustion engine constitutes an engine body E as a passage defining structure together with a cylinder head, an oil pan and the like which are not shown. First, second, third and fourth cylinder portions $\mathbf{13}_1$, $\mathbf{13}_2$, $\mathbf{13}_3$ and $\mathbf{13}_4$, which are vibration generating portions, are provided in the cylinder block in parallel to one another, and pistons 12 are slidably received in the cylinder portions $\mathbf{13}_1$ to $\mathbf{13}_4$, respectively. The cylinder portions $\mathbf{13}_1$ to $\mathbf{13}_4$ are formed with cylinder liners 15 being mounted by a casting-in process on an inner wall 11*a* included in the cylinder block 11 in this embodiment, but mat be formed with an inner surface of the inner wall 11*a* being cut. A cooling-water passage 14 as a liquid passage for flowing of a liquid is defined in the engine body E, and includes a water passage portion 14*a* defined in the cylinder block 11 to commonly surround the cylinder portions $\mathbf{13}_1$ to $\mathbf{13}_4$.

A small clearance exists between an outer surface of each of the pistons 12 and an inner surface of each of the cylinder portions $\mathbf{13}_1$ to $\mathbf{13}_4$. When each of the piston 12 is vertically moved within corresponding one of the cylinder portions $\mathbf{13}_1$ to $\mathbf{13}_4$, the piston 12 collides with the inner surface of each of the cylinder portions $\mathbf{13}_1$ to $\mathbf{13}_4$ to vibrate each of the cylinder portions $\mathbf{13}_1$ to $\mathbf{13}_4$, and such vibration is transmitted to cooling water within the cooling water passage 14. The cooling water is non-compressable and hence, a variation in pressure is produced even by a small vibration, and an exciting force is applied to an outer wall 11*b* of the cylinder block 11 facing the cooling water passage 14 due to the variation in pressure of the cooling water, thereby vibrating the outer wall 11*b* to produce the radiation of a piston slap sound to the outside.

Therefore, vibration absorbing means $\mathbf{16}_1$ for absorbing the vibration of the cooling water within the cooling water passage 14 to inhibit the application of the exciting force to the outer wall 11*b* of the cylinder block 11 to the utmost to provide a reduction in piston slap sound are mounted to the outer wall 11*b* of the cylinder block 11 at locations corresponding to the centers of sleeve bores of the second and third cylinder portions $\mathbf{13}_2$ and $\mathbf{13}_3$ lying at intermediate positions in a direction of arrangement of the cylinder portions $\mathbf{13}_1$ to $\mathbf{13}_4$. Through-bores 17 are provided in the outer wall 11*b* of the cylinder block 11 in correspondence to the vibration absorbing means $\mathbf{16}_1$.

The vibration absorbing means $\mathbf{16}_1$ includes an occluding member $\mathbf{18}_1$ mounted to the outer wall 11*b* to occlude the through-bore 17, an elastic membrane $\mathbf{19}_1$ with one surface facing the water passage portion 14*a* of the cooling water passage 14 and with the other surface facing a space 20 defined between the elastic membrane $\mathbf{19}_1$ and the occluding member $\mathbf{18}_1$, and a retaining member $\mathbf{21}_1$ mounted on the occluding member $\mathbf{18}_1$ for retaining the elastic membrane $\mathbf{19}_1$ between the retaining member $\mathbf{21}_1$ and the occluding member $\mathbf{18}_1$.

Figure 3:
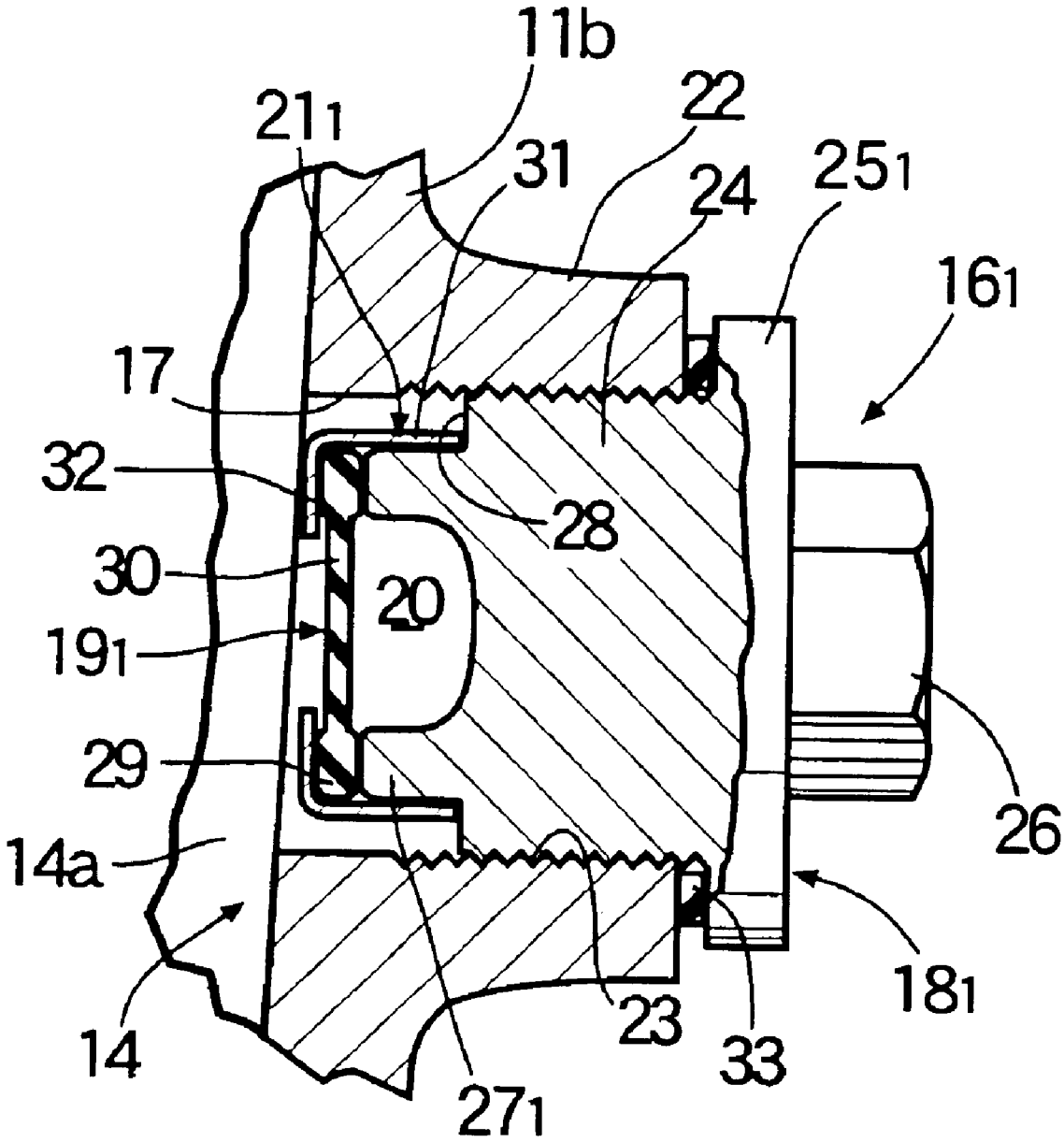

Referring also to FIG. 3, a cylindrical boos portion 22 is integrally and projectingly provided on the outer wall 11*b* of the cylinder block 11, a through-bore 17 is provided in the outer wall 11*b* so that its inner end opens into the water passage portion 14*a* and its outer end opens into an outer end of the boss portion 22. Internal threads 23 are provided on an inner surface of the through-bore 17 to extend at least from the outer end to an intermediate portion of the through-bore 17.

The occluding member $\mathbf{18}_1$ is formed from a metal material having a rigidity, e.g., an aluminum alloy and is integrally provided with (1) a threaded shaft portion 24 threadedly engaged with the internal threads 23, (2) a collar $\mathbf{25}_1$ protruding radially outwards from an outer end of the threaded shaft portion 24, (3) an engaging portion 26 which is formed into a substantially hexagonal shape for engagement of a rotatable tool such as a spanner or the like and which protrudes outwards from a center portion of the outer end of the threaded shaft portion 24, and (4) a cylindrical mounting portion $\mathbf{27}_1$ which coaxially protrudes from an inner end of the threaded shaft portion 24 with a limiting portion 28 as an annular stepped surface being formed between the mounting portion $\mathbf{27}_1$ and the threaded shaft portion 24. The occluding member $\mathbf{18}_1$ is threadedly engaged with the internal threads 23 of the through-bore 17, so that an annular gasket 33 is sandwiched between the protruding collar $\mathbf{25}_1$ and the boss portion 22. In a state in which the occluding member $\mathbf{18}_1$ has been mounted to the boss portion 22, the cylindrical mounting portion $\mathbf{27}_1$ is coaxial with the through-bore 17.

The elastic membrane $\mathbf{19}_1$ is formed from a rubber, a synthetic resin or a metal, which is reinforced with a fabric, a synthetic fiber or a glass fiber. The elastic membrane $\mathbf{19}_1$ includes a thickened ring-shaped sealing portion 29 which is in contact with a tip end face of the mounting portion $\mathbf{27}_1$, and a membrane portion 30 formed at a thickness smaller than that of the sealing portion 29 and integrally connected to an inner periphery of the sealing portion 29 to form a stepped portion.

The retaining portion $\mathbf{21}_1$ is formed from a metal, e.g., an iron-based material such as JIS SP or the like and is integrally provided with a cylindrical portion 31 which is press-fitted over an outer periphery of the mounting portion $\mathbf{27}_1$, until one end thereof abuts against the limiting portion 28 of the occluding member $\mathbf{18}_1$, and a clamping collar 32 which protrudes radially inwards from the other end of the cylindrical portion 31. The length of the cylindrical portion 31 is set at a value such that when one end of the cylindrical portion 31 is press-fitted over the mounting portion $\mathbf{27}_1$, until one end of the cylindrical portion 31 abuts against the limiting portion 28, the cylindrical portion 31 is clamped between the tip end of the mounting portion $\mathbf{27}_1$ and the clamping collar 32, so that the sealing portion 29 of the elastic membrane $\mathbf{19}_1$ is can be crushed in a preset squeeze. The preset squeeze is set, for example, at 25% of the thickness of the sealing portion 29.

In a state in which the vibration absorbing means $\mathbf{16}_1$ has been mounted on the engine body E, the clamping portion 32 of the retaining member $\mathbf{21}_1$ and the elastic membrane $\mathbf{19}_1$ are mounted, so that they do not protrude from the inner surface of the outer wall 11*b* of the cylinder block 11 into the cooling water passage 14.

It is desirable that positions of disposition of the through-bore 17 and the vibration absorbing means $\mathbf{16}_1$ are near positions in which the piston 12 applies a shock to inner surfaces of the second and third cylinder portions $\mathbf{13}_2$ and $\mathbf{13}_3$. It is known that the timing of generation of a slap vibration relative to a crank angle is within 25 degree before and after a top dead center of the piston 12. Therefore, it is desirable that when a sum of the amount of piston 12 displaced at 25 degree before and after the top dead center and the axial length of the piston 12 is represented by A, the through-bore 17 and the vibration absorbing means $\mathbf{16}_1$ are disposed in an area corresponding to a range of A from the upper surface of the cylinder block 11.

Figure 4:
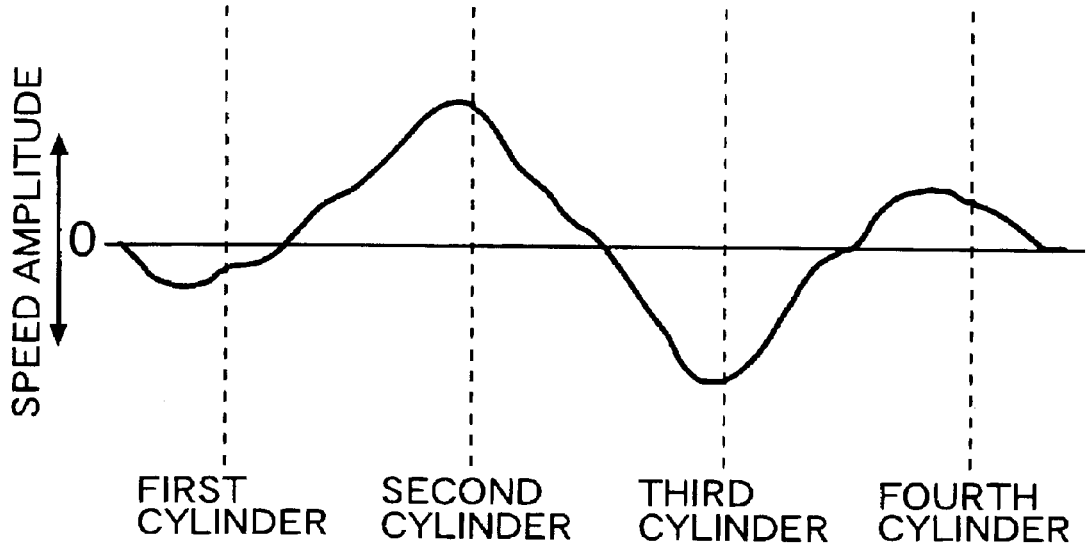

The experiment made by the present inventors shows that the speed amplitude of the vibration attendant on the shock from the pistons 12 in the cylinders $\mathbf{13}_1$ to $\mathbf{13}_4$ is varied as shown in FIG. 4 in the direction of arrangement of the cylinder portions $\mathbf{13}_1$ to $\mathbf{13}_4$, and is larger at a point corresponding to the sleeve bore centers of the second and third cylinder portions $\mathbf{13}_2$ and $\mathbf{13}_3$ which is intermediate points in the direction of arrangement of the cylinder portions $\mathbf{13}_1$ to $\mathbf{13}_4$. Therefore, it is desirable that the through-bore 17 and the vibration absorbing means $\mathbf{16}_1$ are disposed in the outer wall 11*b* of the cylinder block 11 at locations corresponding to the sleeve bore centers of the second and third cylinder portions $\mathbf{13}_2$ and $\mathbf{13}_3$, when the cylinder block 11 is viewed from the side perpendicular to the direction of arrangement of the cylinder portions $\mathbf{13}_1$ to $\mathbf{13}_4$.

The operation of the first embodiment will be described below. When the pistons 12 collide with the inner surfaces of the cylinder portions $\mathbf{13}_1$ to $\mathbf{13}_4$ due to the existence of the small clearances between the outer surfaces of the pistons 12 and the inner surfaces of the cylinder portions $\mathbf{13}_1$ to $\mathbf{13}_4$, such vibration is transmitted to the non-compressable cooling water within the cooling water passage 14 to induce a variation in pressure of the cooling water. However, the through-bore 17 is provided in the outer wall 11*b* of the cylinder block 11 at the portion facing the water passage portion 14*a* of the cooling water passage 14, and the vibration absorbing means $\mathbf{16}_1$ is mounted to occlude the through-bore 17. The vibration absorbing means $\mathbf{16}_1$ includes the occluding member $\mathbf{18}_1$ which occludes the through-bore 17, the elastic membrane $\mathbf{19}_1$ with one surface thereof facing the water passage portion 14*a* of the liquid passage 14 and with the other surface thereof facing the space 20 defined between the elastic membrane $\mathbf{19}_1$ and the occluding member $\mathbf{18}_1$, and the retaining member $\mathbf{21}_1$ which is mounted to the occluding member $\mathbf{18}_1$ and retains the elastic membrane $\mathbf{19}_1$ between the retaining member $\mathbf{21}_1$ and the occluding member $\mathbf{18}_1$. Therefore, the variation in pressure of the cooling water is absorbed by the flexing of the membrane portion 30 of the elastic membrane $\mathbf{19}_1$, thereby effectively reducing the exciting force applied from the cooling water to the outer wall 11*b* of the cylinder block 11. Moreover, the space 20 faced by the other surface of the elastic membrane $\mathbf{19}_1$ is covered with the occluding member $\mathbf{18}_1$ and hence, a sound produced due to the vibration of the elastic membrane $\mathbf{19}_1$ cannot be radiated from the occluding member $\mathbf{18}_1$ to the outside, and a piston slap sound radiated from the cylinder block can be effectively reduced.

Further, since the vibration absorbing means $\mathbf{16}_1$ is mounted to a portion of the outer wall of the cylinder block 11, the increase in weight of the cylinder block 11 and thus the engine body E due to the vibration absorbing means $\mathbf{16}_1$ can be suppressed to a small level to the utmost. Moreover, the occluding member $\mathbf{18}_1$ is screwed into the through bore 17, and the operation for mounting and removing the vibration absorbing means $\mathbf{16}_1$ to and from the engine body E is extremely easy and further, the replacement and maintenance of the elastic membrane $\mathbf{19}_1$ can be easily carried out.

Since the elastic membrane $\mathbf{19}_1$ is clamped and retained between the occluding member $\mathbf{18}_1$ and the retaining member $\mathbf{21}_1$, it is possible to avoid that the sealability is reduced by the water pressure in the cooling water passage 14 and/or the deterioration of the elastic membrane $\mathbf{19}_1$, to reliably retaining the elastic membrane $\mathbf{19}_1$ by the retaining member $\mathbf{21}_1$, and to provide an excellent sealability, as compared with a case where the elastic membrane is secured directly to the occluding member by baking or adhering.

Moreover, the retaining member $\mathbf{21}_1$ is press-fitted over the mounting portion $\mathbf{27}_1$ with the sealing portion 29 which is the outer periphery of the elastic membrane $\mathbf{19}_1$ being clamped between the retaining member $\mathbf{21}_1$ and the occluding member $\mathbf{18}_1$, and the limiting portion 28 for limiting the end of movement of the retaining member $\mathbf{21}_1$ in a direction of press-fitting over the occluding member $\mathbf{18}_1$. Therefore, it is possible to reliably retain the elastic membrane $\mathbf{19}_1$ on the occluding member $\mathbf{18}_1$. In addition, the retaining member $\mathbf{21}_1$ may be press-fitted until the press-fitting thereof is limited by the limiting portion 28 and therefore, the sealability of the elastic membrane $\mathbf{19}_1$ can be sufficiently ensured, while enhancing the press-fitting operability.

The clamping collar 32 of the retaining member $\mathbf{21}_1$ and the elastic membrane $\mathbf{19}_1$ do not protrude from the inner surface of the outer wall 11*b* of the cylinder block 11 into the cooling water passage 14. Therefore, it is possible to avoid, to the utmost, that the flowing of the cooling water in the cooling water passage 14 is hindered by the retaining member $\mathbf{21}_1$ and the elastic membrane $\mathbf{19}_1$, whereby the flowing of the cooling water in the cooling water passage 14 can be smoothened, and it is possible to maintain the cooling performance to the same extent as in the conventional water-cooled internal combustion engine which is not provided with the vibration absorbing means $\mathbf{16}_1$.

Figure 5:
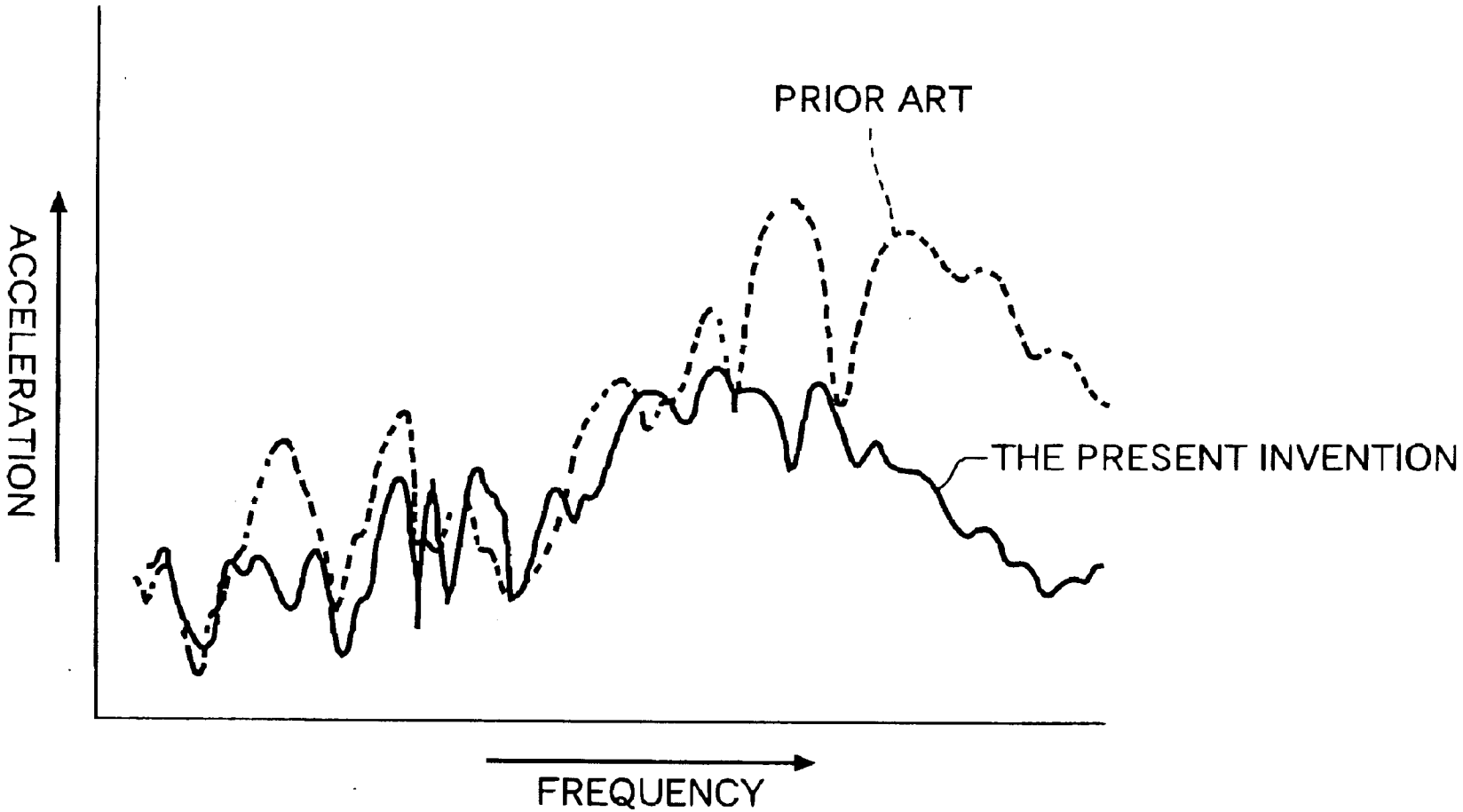

Here, the result of the inspection of the acceleration of the vibration of the outer wall 11*b* of the cylinder block 11 at a portion corresponding to the third cylinder portion $\mathbf{13}_3$ is as shown in FIG. 5. In the conventional water-cooled internal combustion engine which is not provided with the vibration absorbing means $\mathbf{16}_1$, the acceleration is relatively high as shown by a dashed line, and according to the present invention, the acceleration is effectively reduced as shown by a solid line. Thus, it is obvious that the piston slap sound can be effectively reduced by the vibration absorbing means $\mathbf{16}_1$ according to the present invention.

Figure 6:
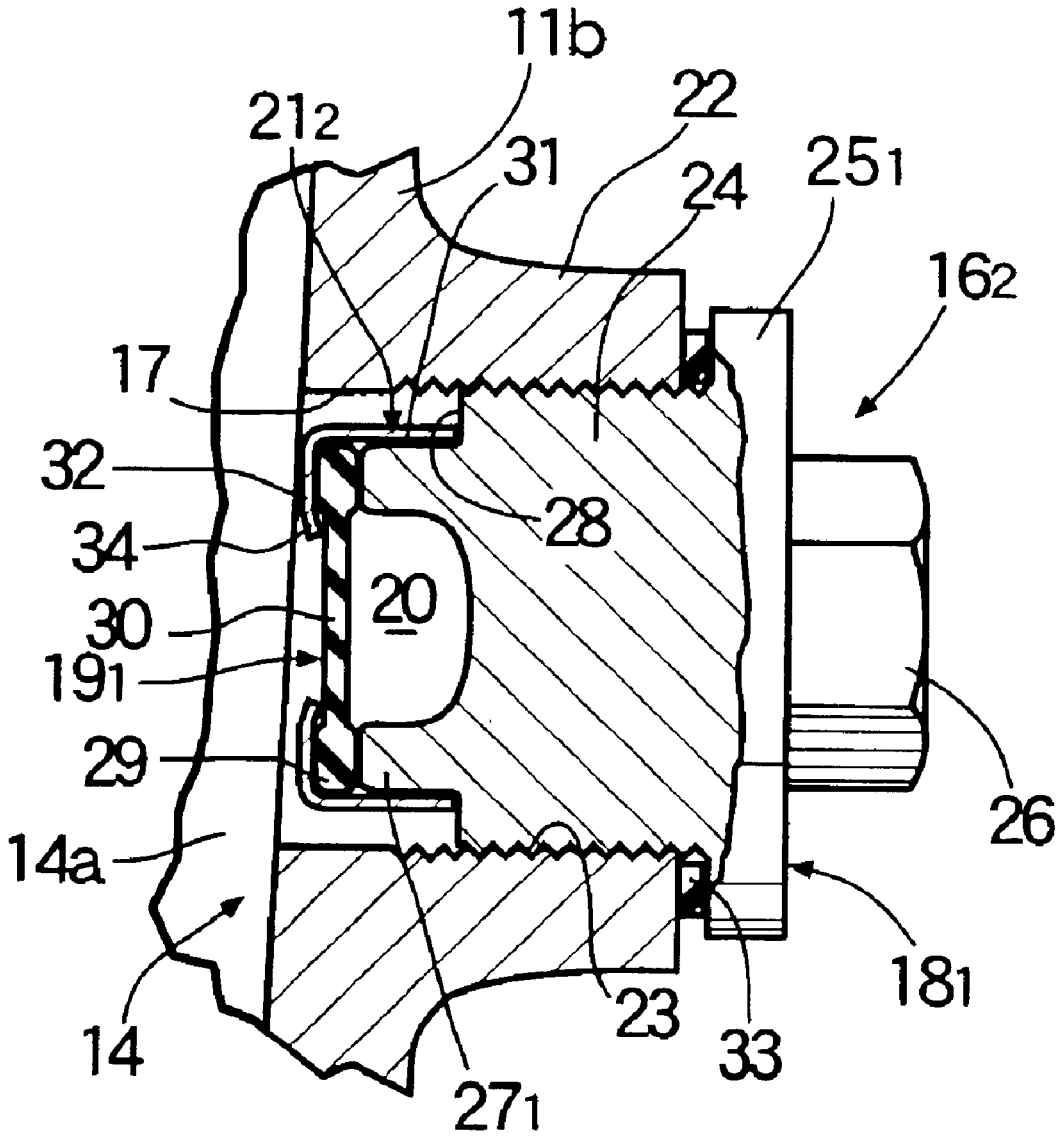
FIG. 6 is a sectional view similar to FIG. 3, but according to a second embodiment of the present invention.

FIG. 6 shows a second embodiment of the present invention, wherein portions or components corresponding to those In the first embodiment are designated by like reference characters.

A vibration absorbing means 162 is mounted to the outer wall 11*b* of the cylinder block 11 to occlude a through-bore 17 provided in the outer wall 11*b* of the cylinder block 11. The vibration absorbing means $\mathbf{16}_2$ includes an occluding member $\mathbf{18}_1$ for occluding the through-bore 17, an elastic membrane $\mathbf{19}_1$ with one surface thereof facing the water passage portion 14*a* of the liquid passage 14 and with the other surface thereof facing a space 20 defined between the elastic membrane $\mathbf{19}_1$ and the occluding member $\mathbf{18}_1$, and a retaining member $\mathbf{21}_2$ mounted to the occluding member $\mathbf{18}_1$ for retaining the elastic membrane $\mathbf{19}_1$ between the retaining member $\mathbf{21}_2$ and the occluding member $\mathbf{18}_1$.

The retaining member $\mathbf{21}_2$ is formed from a metal and is integrally provided with (1) a cylindrical portion 31 press-fitted over an outer periphery of the mounting portion $\mathbf{27}_1$ of the occluding member $\mathbf{18}_1$, until one end thereof abuts against the limiting portion 28 of the occluding member $\mathbf{18}_1$, (2) a clamping collar 32 protruding radially inwards from the other end of the cylindrical portion 31 and adapted to clamp the sealing portion 29 of the elastic membrane $\mathbf{19}_1$ between the clamping collar 32 and a tip end of the mounting portion $\mathbf{27}_1$, and (3) a positioning portion 34 engaged with an inner periphery of the sealing portion 29 to position the elastic membrane $\mathbf{19}_1$ in a plane perpendicular to an axis of the mounting portion $\mathbf{27}_1$. The positioning portion 34 is formed by slightly folding the inner periphery of the clamping collar 32 axially inwards.

According to the second embodiment, an effect similar to that in the first embodiment is provided and moreover, the sealing portion 29 of the elastic membrane $\mathbf{19}_1$ is accurately positioned between the mounting portion $\mathbf{27}_1$ and the retaining member $\mathbf{21}_2$. Thus, the sealability of the sealing portion 29 can be sufficiently ensured to enhance the vibration absorbing characteristic.

Figure 7:
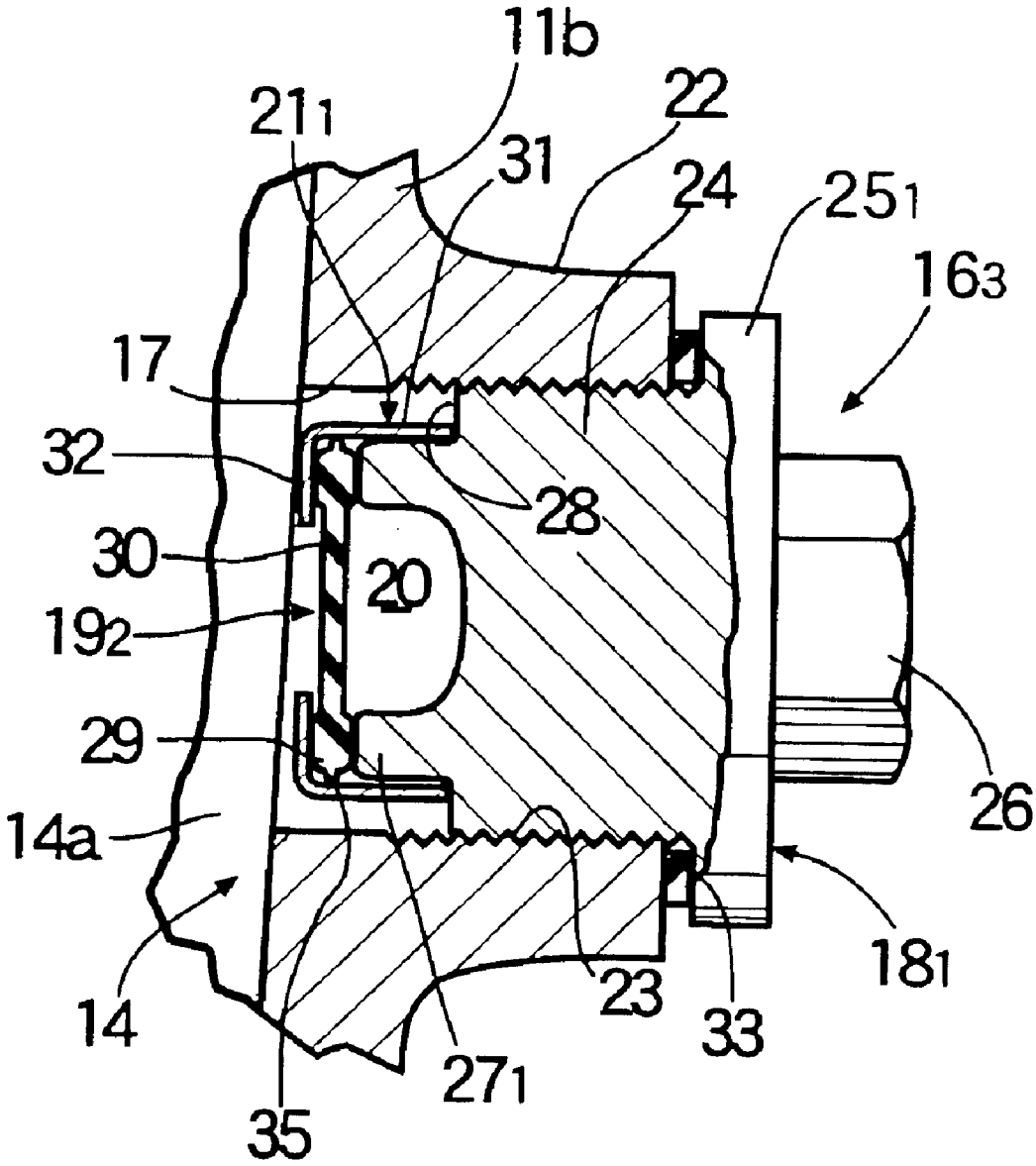
FIG. 7 is a sectional view similar to FIG. 3, but according to a third embodiment of the present invention.

FIG. 7 shows a third embodiment of the present invention, wherein portions or components corresponding to those in each of the previously described embodiments are designated by like reference characters.

A vibration absorbing means $\mathbf{16}_3$ is mounted to the outer wall 11*b* of the cylinder block 11 to occlude a through-bore 17 provided in the outer wall 11*b* of the cylinder block 11. The vibration absorbing means $\mathbf{16}_3$ includes an occluding member $\mathbf{18}_1$ for occluding the through-bore 17, an elastic membrane $\mathbf{19}_2$ with one surface thereof facing the water passage portion 14*a* of the liquid passage 14 and with the other surface thereof facing a space 20 defined between the elastic membrane $\mathbf{19}_1$ and the occluding member $\mathbf{18}_1$, and a retaining member $\mathbf{21}_1$ mounted to the occluding member $\mathbf{18}_1$ for retaining the elastic membrane $\mathbf{19}_2$ between the retaining member $\mathbf{21}_1$ and the occluding member $\mathbf{18}_1$.

The elastic membrane $\mathbf{19}_2$ is integrally provided with (1) a thicker ring-shaped sealing portion 29 which is in contact with a tip end face of a mounting portion $\mathbf{27}_1$ in the occluding member $\mathbf{18}_1$, (2) a membrane portion 30 formed thinner than the sealing portion 29 and integrally connected to an inner periphery of the sealing portion 29 with a stepped portion formed therebetween, and (3) an annular lip portion 35 which protrudes outwards from an outer periphery of the sealing portion 29. Thus, the elastic membrane $\mathbf{19}_2$ is positioned in a plane perpendicular to an axis of the mounting portion $\mathbf{27}_1$ by contact with of the lip portion 35 with an inner surface of that cylindrical portion 31 of the retaining member $\mathbf{21}_1$ which is press-fitted over an outer periphery of the mounting portion $\mathbf{27}_1$.

According to the third embodiment, an effect similar to that in the first embodiment is provided and moreover, the sealing portion 29 of the elastic membrane $\mathbf{19}_2$ is accurately positioned and clamped between the mounting portion $\mathbf{27}_1$ and the retaining member $\mathbf{21}_1$. Thus, the sealability of the sealing portion 29 can be further sufficiently ensured to enhance the vibration absorbing characteristic. Moreover, a flash produced around the outer periphery of the elastic membrane $\mathbf{19}_2$ upon formation of the elastic membrane $\mathbf{19}_2$ by molding can be effectively utilized as the lip portion 35, whereby a flash removing operation is not required after formation of the elastic membrane $\mathbf{19}_2$.

Figure 8:
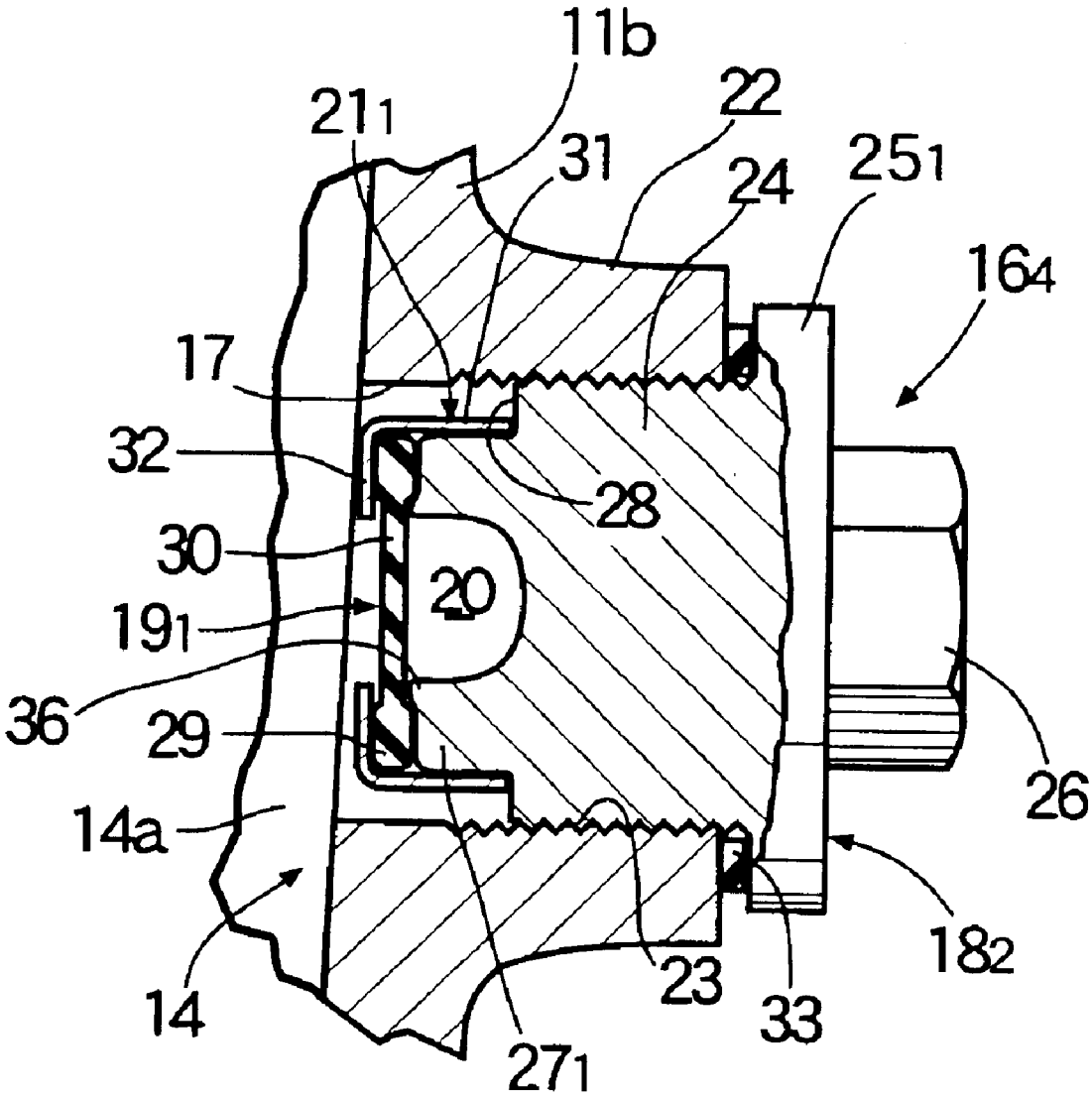
FIG. 8 is a sectional view similar to FIG. 3, but according to a fourth embodiment of the present invention.

FIG. 8 shows a fourth embodiment of the present invention, wherein portions or components corresponding to those in each of the previously described embodiments are designated by like reference characters.

A vibration absorbing means $\mathbf{16}_4$ is mounted to the outer wall lib of the cylinder block 11 to occlude a through-bore 17 provided in the outer wall 11*b* of the cylinder block 11. The vibration absorbing means $\mathbf{16}_4$ includes an occluding member $\mathbf{18}_2$ for occluding the through-bore 17, an elastic membrane $\mathbf{19}_1$ with one surface thereof facing the water passage portion 14*a* of the liquid passage 14 and with the other surface thereof facing a space 20 defined between the elastic membrane $\mathbf{19}_1$ and the occluding member $\mathbf{18}_2$, and a retaining member $\mathbf{21}_1$ mounted to the occluding member $\mathbf{18}_2$ for retaining the elastic membrane $\mathbf{19}_1$ between the retaining member $\mathbf{21}_1$ and the occluding member $\mathbf{18}_2$.

The occluding member $\mathbf{18}_2$ is formed from a metal material to have a rigidity and is integrally provided with (1) a threaded shaft portion 24 threadedly engaged with internal threads 23 of the through-bore 17, (2) a protrusion collar $\mathbf{25}_1$ protruding radially outwards from an outer end of the threaded shaft portion 24, (3) an engaging portion 26 protruding outwards from a central portion of the outer end of the threaded shaft portion 24, (4) a cylindrical mounting portion $\mathbf{27}_1$ coaxially protruding from an inner end of the threaded shaft portion 24 with a step-shaped limiting portion 28 formed between the cylindrical mounting portion $\mathbf{27}_1$ and the threaded shaft portion 24, and (5) an annular engage portion 36 which protrudes from an inner peripheral edge of a tip end of the mounting portion $\mathbf{27}_1$ to engage an inner periphery of a sealing portion 29 in the elastic membrane $\mathbf{19}_1$.

According to the fourth embodiment, an effect similar to that in the first embodiment is provided and moreover, the sealing portion 29 of the elastic membrane $\mathbf{19}_1$ is accurately positioned in a plane perpendicular to an axis of the mounting portion $\mathbf{27}_1$ by the annular engage portion 36 and clamped between the mounting portion $\mathbf{27}_1$ and the retaining member $\mathbf{21}_1$. Thus, the sealability of the sealing portion 29 can be further sufficiently ensured to enhance the vibration absorbing characteristic.

Figure 9:
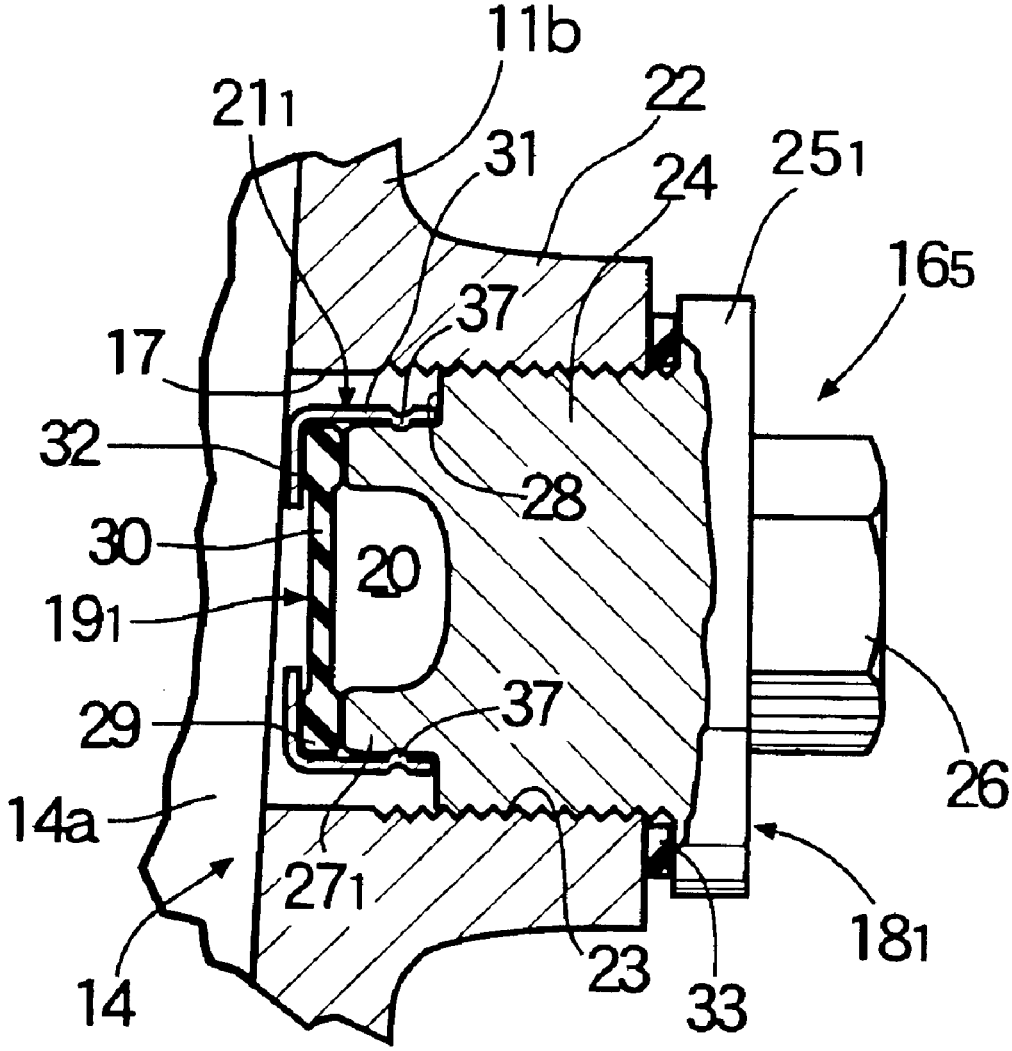
FIG. 9 is a sectional view similar to FIG. 3, but according to a fifth embodiment of the present invention.

FIG. 9 shows a fifth embodiment of the present invention, wherein portions or components corresponding to those in each of the previously described embodiments are designated by like reference characters.

A vibration absorbing means $\mathbf{16}_5$ is mounted to the outer wall 11*b* of the cylinder block 11 to occlude a through-bore 17 provided in the outer wall 11*b* of the cylinder block 11. As in the first embodiment, the vibration absorbing means $\mathbf{16}_s$ includes an occluding member $\mathbf{18}_1$ for occluding the through-bore 17, an elastic membrane $\mathbf{19}_1$ with one surface thereof facing the water passage portion 14*a* of the liquid passage 14 and with the other surface thereof facing a space 20 defined between the elastic membrane $\mathbf{19}_1$ and the occluding member $\mathbf{18}_1$ and a retaining member $\mathbf{21}_1$ fixedly mounted to the occluding member $\mathbf{18}_1$ for retaining the elastic membrane $\mathbf{19}_1$ between the retaining member $\mathbf{21}_1$ and the occluding member $\mathbf{18}_1$. A cylindrical portion 31 of the retaining member $\mathbf{21}_1$ is engaged by caulking with an outer surface of a mounting portion $\mathbf{27}_1$ of the retaining member $\mathbf{18}_1$.

After press-fitting of the cylindrical portion 31 over the mounting portion $\mathbf{27}_1$, an inward pressing force is applied to the cylindrical portion 31 at one point or a plurality of points in a circumferential direction as in this embodiment by a punch which is not shown, whereby projections 37 protruding radially inwards from the cylindrical portion 31 are engaged with an outer surface of the mounting portion $\mathbf{27}_1$ of the occluding member $\mathbf{18}_1$ in a biting-in manner.

According to the fifth embodiment, it is possible to prevent the loosening of the retaining member $\mathbf{21}_1$ press-fitted over the mounting portion $\mathbf{27}_1$. More specifically, when the occluding member $\mathbf{18}_1$ is made, for example, from an aluminum alloy and the retaining member $\mathbf{21}_1$ is made, for example, from an iron-based material such as JIS SP or the like, it is considered that the retaining member $\mathbf{21}_1$ is loosened due to a differential thermal expansion produced by a variation in temperature caused by operation of the engine. However, by using the above-described caulking structure, the loosening of the retaining member $\mathbf{21}_1$ can be reliably prevented, thereby reliably maintaining the sealability of the sealing portion 28 of the elastic membrane $\mathbf{19}_1$.

Figure 10:
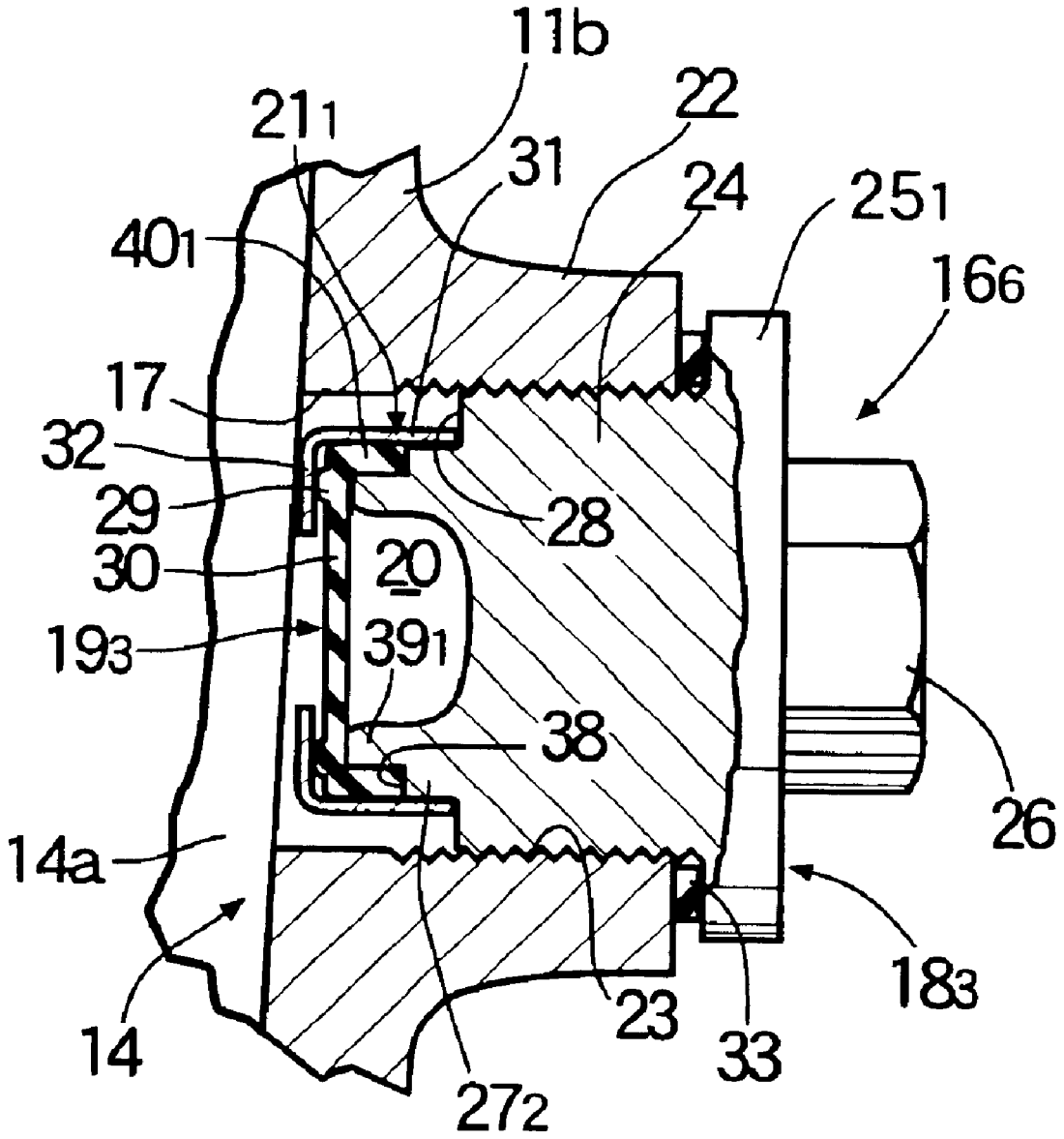
FIG. 10 is a sectional view similar to FIG. 3, but according to a sixth embodiment of the present invention.

FIG. 10 shows a sixth embodiment of the present invention, wherein portions or components corresponding to those in each of the previous embodiments are designated by like reference characters.

A vibration absorbing means $\mathbf{16}_6$ is mounted to the outer wall 11*b* of the cylinder block 11 to occlude a through-bore 17 provided in the outer wall 11*b* of the cylinder block 11. The vibration absorbing means $\mathbf{16}_6$ includes an occluding member $\mathbf{18}_3$ for occluding the through-bore 17, an elastic membrane $\mathbf{19}_3$ with one surface thereof facing the water passage portion 14*a* of the liquid passage 14 and with the other surface thereof facing a space 20 defined between the elastic membrane $\mathbf{19}_3$ and the occluding member $\mathbf{18}_3$, and a retaining member $\mathbf{21}_1$ mounted to the occluding member $\mathbf{18}_3$ for retaining the elastic membrane $\mathbf{19}_3$ between the retaining member $\mathbf{21}_1$ and the occluding member $\mathbf{18}_3$.

The occluding member $\mathbf{18}_3$ includes a threaded shaft portion 24 threadedly engaged with internal threads 23 of the through-bore 17, a protrusion collar $\mathbf{25}_1$ protruding radially outwards from an outer end of the threaded shaft portion 24, an engaging portion 26 protruding outwards from a central portion of the outer end of the threaded shaft portion 24, and a cylindrical mounting portion $\mathbf{27}_2$ coaxially protruding from an inner end of the threaded shaft portion 24 with a step-shaped limiting portion 28 formed between the cylindrical mounting portion $\mathbf{27}_2$ and the threaded shaft portion 24. A smaller-diameter cylindrical portion $\mathbf{39}_1$ is formed on an outer periphery of the mounting portion $\mathbf{27}_2$ to extend from an intermediate portion toward a tip end of the mounting portion $\mathbf{27}_2$, with an annular step 38 provided to face the tip end.

On the other hand, the elastic membrane $\mathbf{19}_3$ is integrally provided with (1) a thicker ring- shaped sealing portion 29 which is in contact with a tip end face of the mounting portion $\mathbf{27}_2$ of the occluding member $\mathbf{18}_3$, i.e., a tip end face of the smaller-diameter cylindrical portion $\mathbf{39}_1$, (2) a membrane portion 30 formed thinner than the sealing portion 29 and integrally connected to an inner periphery of the sealing portion 29 with a step formed therebetween, and (3) a fitting cylindrical portion 401 which is connected to an outer periphery of the sealing portion 29 and fitted over the smaller-diameter cylindrical portion $\mathbf{39}_1$.

According to the sixth embodiment, the falling of the elastic membrane $\mathbf{19}_3$ from between the retaining member $\mathbf{21}_1$ and the occluding member $\mathbf{18}_3$ is effectively inhibited by fitting of the fitting cylindrical portion $\mathbf{40}_1$ of the elastic membrane $\mathbf{19}_3$ over the tip end of the mounting portion $\mathbf{27}_2$ of the occluding member $\mathbf{18}_3$.

Figure 11:
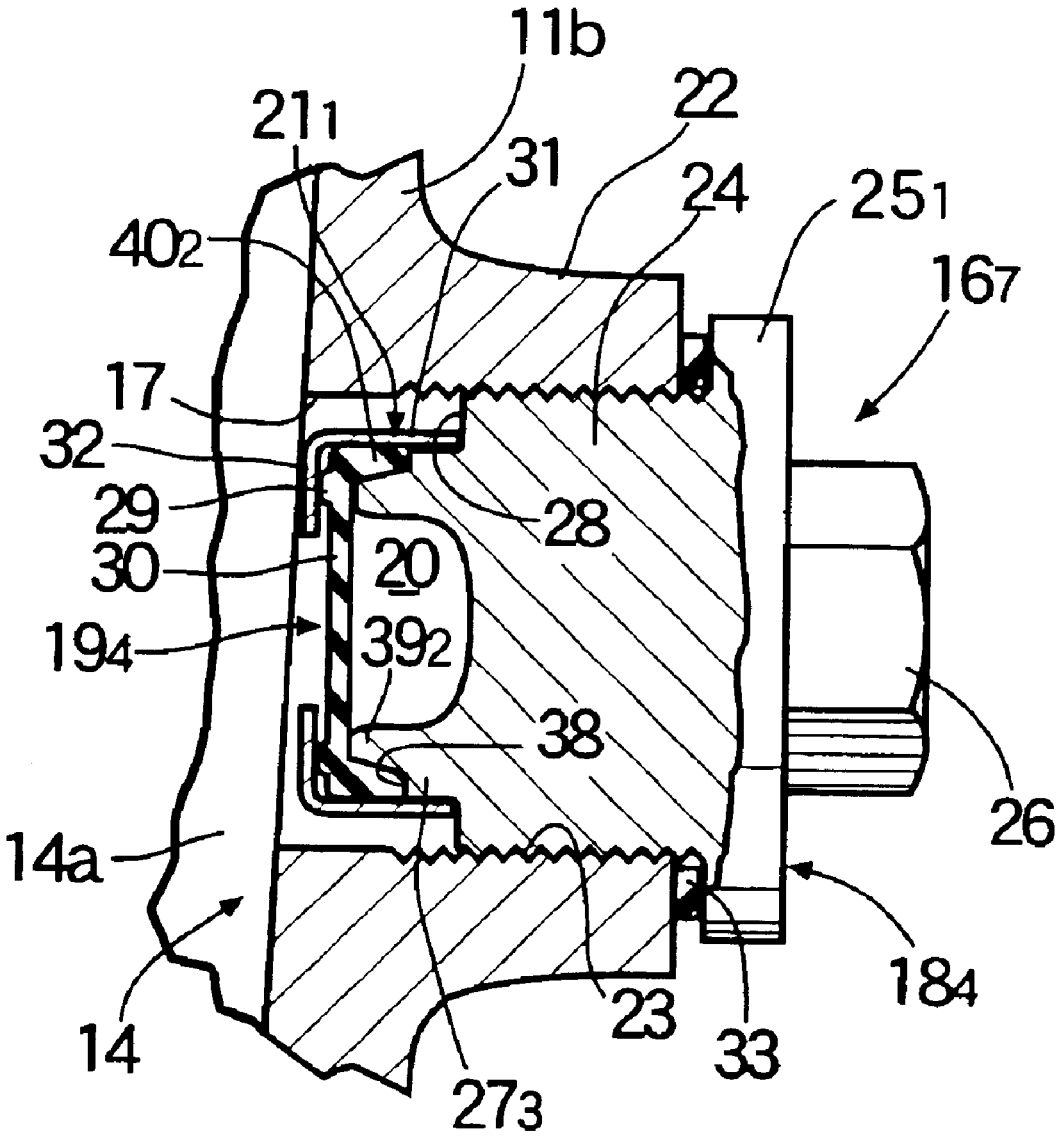
FIG. 11 is a sectional view similar to FIG. 3, but according to a seventh embodiment of the present invention.

FIG. 11 shows a seventh embodiment of the present invention, wherein portions or components corresponding those in each of the previous embodiments are designated by like reference characters.

A vibration absorbing means $\mathbf{16}_7$ is mounted to the outer wall 11*b* of the cylinder block 11 to occlude a through-bore 17 provided in the outer wall 11*b* of the cylinder block 11. The vibration absorbing means $\mathbf{16}_7$ includes an occluding member $\mathbf{18}_4$ for occluding the through-bore 17, an elastic membrane $\mathbf{19}_4$ with one surface thereof facing the water passage portion 14*a* of the liquid passage 14 and with the other surface thereof facing a space 20 defined between the elastic membrane $\mathbf{19}_4$ and the occluding member $\mathbf{18}_4$, and a retaining member $\mathbf{21}_1$ mounted to the occluding member $\mathbf{18}_4$ for retaining the elastic membrane $\mathbf{19}_4$ between the retaining member $\mathbf{21}_1$ and the occluding member $\mathbf{18}_4$.

The occluding member $\mathbf{18}_4$ includes a threaded shaft portion 24 threadedly engaged with internal threads 23 of the through-bore 17, a protrusion collar $\mathbf{25}_1$ protruding radially outwards from an outer end of the threaded shaft portion 24, an engaging portion 26 protruding outwards from a central portion of the outer end of the threaded shaft portion 24, and a cylindrical mounting portion $\mathbf{27}_3$ coaxially protruding from an inner end of the threaded shaft portion 24 with a step-shaped limiting portion 28 formed between the cylindrical mounting portion $\mathbf{27}_3$, and the threaded shaft portion 24. A smaller-diameter cylindrical portion $\mathbf{39}_2$ is formed on an outer periphery of the mounting portion $\mathbf{27}_3$ to extend from an intermediate portion toward a tip end of the mounting portion $\mathbf{27}_3$, and has a tapered outer surface which is reduced in diameter toward tip end thereof.

On the other hand, the elastic membrane $\mathbf{19}_4$ is integrally provided with (1) a thicker ring-shaped sealing portion 29 which is in contact with a tip end face of the mounting portion $\mathbf{27}_3$ of the occluding member $\mathbf{18}_4$, i.e., a tip end face of the smaller-diameter cylindrical portion $\mathbf{39}_2$, (2) a membrane portion 30 formed thinner than the sealing portion 29 and integrally connected to an inner periphery of the sealing portion 29 with a step formed therebetween, and (3) a fitting cylindrical portion $\mathbf{40}_2$ which is connected to an outer periphery of the sealing portion 29 and which has an inner surface formed in a tapered shape, so that it is fitted over the smaller-diameter cylindrical portion $\mathbf{39}_2$.

According to the seventh embodiment, the falling of the elastic membrane $\mathbf{19}_4$ from between the retaining member $\mathbf{21}_1$ and the occluding member $\mathbf{18}_4$ can be effectively inhibited, and the inner surface of the fitting cylindrical portion $\mathbf{40}_2$ can be brought into close contact with the outer surface of the smaller-diameter cylindrical portion $\mathbf{39}_2$ to further enhance the sealability.

Figure 12:
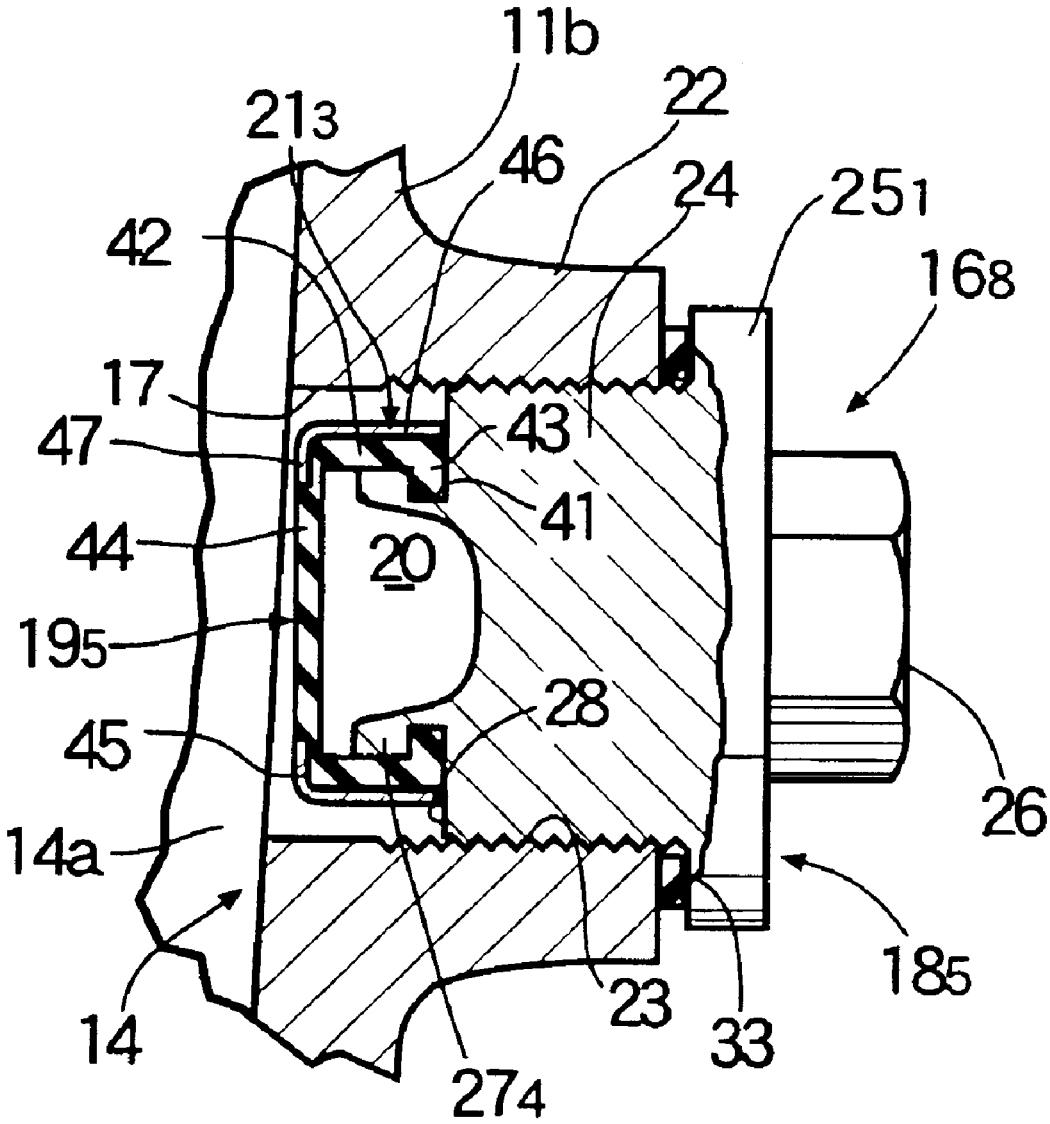
FIG. 12 is a sectional view similar to FIG. 3, but according to an eighth embodiment of the present invention.

FIG. 12 shows an eighth embodiment of the present invention, wherein portions or components corresponding to those in each of the previous embodiments are designated by like reference characters.

A vibration absorbing means $\mathbf{16}_8$ is mounted to the outer wall 11*b* of the cylinder block 11 to occlude a through-bore 17 provided in the outer wall 11*b* of the cylinder block 11. The vibration absorbing means $\mathbf{16}_8$ includes an occluding member $\mathbf{18}_5$ for occluding the through-bore 17, an elastic membrane $\mathbf{19}_5$ with one surface thereof facing the water passage portion 14*a* of the liquid passage 14 and with the other surface thereof facing a space 20 defined between the elastic membrane $\mathbf{19}_5$ and the occluding member $\mathbf{18}_5$, and a retaining member $\mathbf{21}_3$ mounted to the occluding member $\mathbf{18}_5$ for retaining the elastic membrane $\mathbf{19}_5$ between the retaining member $\mathbf{21}_3$ and the occluding member $\mathbf{18}_5$.

The occluding member $\mathbf{18}_s$ includes a threaded shaft portion 24 threadedly engaged with internal threads 23 of the through-bore 17, a protrusion collar $\mathbf{25}_1$ protruding radially outwards from an outer end of the threaded shaft portion 24, an engaging portion 26 protruding outwards from a central portion of the outer end of the threaded shaft portion 24, and a cylindrical mounting portion $\mathbf{27}_4$ coaxially protruding from an inner end of the threaded shaft portion 24 with a step-shaped limiting portion 28 formed between the cylindrical mounting portion $\mathbf{27}_4$ and the threaded shaft portion 24. An annular recess 41 is defined around an outer periphery of an base of the mounting portion $\mathbf{27}_4$.

On the other hand, the elastic membrane $\mathbf{19}_5$ is integrally provided with (1) a cylindrical sealing portion 42 which is resiliently fitted over an outer periphery of the mounting portion $\mathbf{27}_4$ of the occluding member $\mathbf{18}_5$, (2) a fitting collar 43 which protrudes radially inwards from one end of the sealing portion 42 and which is fitted into the annular recess 41 in the mounting portion $\mathbf{27}_4$, and a disk-shaped membrane portion 44 having the entire outer periphery connected to the other end of the sealing portion 42. An engage recess 45 is defined in the outer periphery of the membrane portion 44.

Further, the retaining member $\mathbf{21}_3$ is formed from a metal, and includes a cylindrical portion 46 press-fitted over an outer periphery of the mounting portion 27 through the sealing portion 42 of the elastic membrane $\mathbf{19}_5$ interposed therebetween, and an engage collar 47 protruding radially inwards from an end of the cylindrical portion 46 to engage the engage recess 45.

According to the eighth embodiment, it is possible to set the effective diameter of the elastic membrane $\mathbf{19}_5$, i.e., the effective diameter of the membrane portion 44 at a relatively large value, and this can contribute to a reduction in size of the vibration absorbing means $\mathbf{16}_8$.

Figure 13:
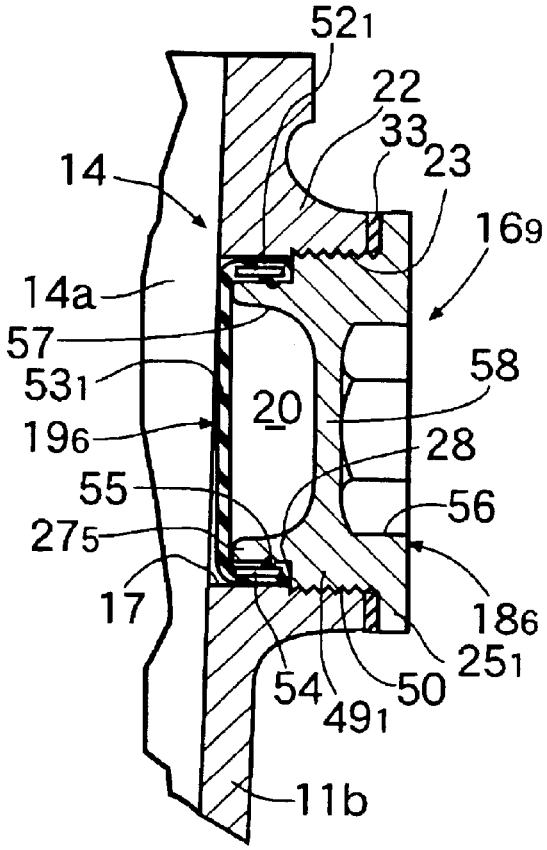
Figure 14:
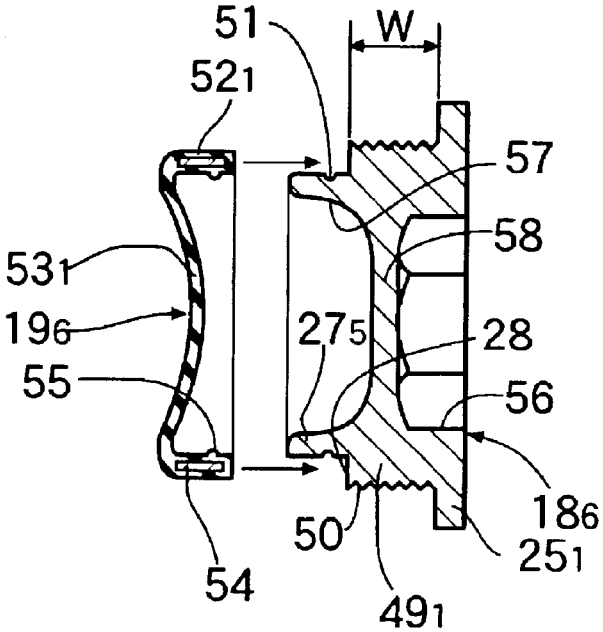

FIGS. 13 and 14 show a ninth embodiment of the present invention. A vibration absorbing means $\mathbf{16}_9$ includes an occluding member $\mathbf{18}_6$ for occluding a through-bore provided in a boss portion 22 of the outer wall 11*b*, and an elastic membrane $\mathbf{19}_6$ press-fitted over and fixed to the occluding member $\mathbf{18}_6$ with one surface,thereof facing the water passage portion 14*a* of the cooling water passage 14 and with the other surface thereof facing a space 20 defined between the elastic membrane $\mathbf{19}_6$ and the occluding member $\mathbf{18}_6$.

The occluding member $\mathbf{18}_6$ is formed from a metal material having a rigidity such as an aluminum alloy and is integrally provided with (1) a cylindrical support tube portion $\mathbf{49}_1$, (2) a protrusion collar $\mathbf{25}_1$ protruding radially outwards from an outer end of the support tube portion $\mathbf{49}_1$, and (3) a cylindrical mounting portion $\mathbf{27}_5$ coaxially protruding from an inner end of the support tube portion $\mathbf{49}_1$ with a limiting portion 28 as an annular stepped surface being formed between the cylindrical mounting portion $\mathbf{27}_5$ and the support tube portion $\mathbf{49}_1$. An external threads 50 are provided around an outer periphery of the support tube portion $\mathbf{49}_1$ and meshed with internal threads of the mounting bore 17, and an annular engage groove 51 is provided in an outer periphery of the mounting portion $\mathbf{27}_5$.

The elastic membrane $\mathbf{19}_6$ is formed from a rubber or a synthetic resin, e.g., an ethylene-based or propylene-based rubber or a metal, which is reinforced, for example, with a fabric, a synthetic fiber or a glass fiber to enhance the durability of the elastic membrane $\mathbf{19}_6$. The elastic membrane $\mathbf{19}_6$ is formed into a bottomed cylindrical shape and comprised of a cylindrical sealing portion $\mathbf{52}_1$ press-fitted over the outer periphery of the mounting portion $\mathbf{27}_5$ of the occluding member $\mathbf{18}_6$ with one surface thereof abutting against the limiting portion 28, and a membrane portion $\mathbf{53}_1$ connected to the other end of the sealing portion $\mathbf{52}_1$ to form a space 20 between the membrane portion $\mathbf{53}_1$ and the occluding member $\mathbf{18}_6$.

Moreover, a ring-shaped reinforcing member 54 is mounted in the sealing portion $\mathbf{52}_1$ of the elastic membrane $\mathbf{19}_6$ and made from a metal when the elastic membrane $\mathbf{19}_6$ is made of a non-metal. The reinforcing member 54 is mounted in the sealing portion $\mathbf{52}_1$ by baking or the like, so that it is entirely wrapped with the sealing portion $\mathbf{52}_1$.

In order to avoid that the pressure in the space 20 defined between the membrane portion $\mathbf{53}_1$ of the elastic membrane $\mathbf{19}_6$ and the mounting portion $\mathbf{27}_5$ is increased to cause the membrane portion $\mathbf{53}_1$ to be expanded toward the cooling water passage 14, when the sealing portion $\mathbf{52}_1$ of the elastic membrane $\mathbf{19}_6$ is press-fitted over the outer periphery of the mounting portion $\mathbf{27}_5$ in the occluding member $\mathbf{18}_6$, the membrane portion $\mathbf{53}_1$ of the elastic membrane $\mathbf{19}_6$ is formed into a shape in which it has been expanded toward the occluding member $\mathbf{18}_6$ in a natural state with no external force applied thereto, as shown in FIG. 14. Thus, the membrane portion $\mathbf{53}_1$ is deformed into a flat disk-shape, as shown in FIG. 13, in accordance with an increase in pressure in the space 20 caused by the press-fitting of the sealing portion $\mathbf{53}_1$ over the outer periphery of the mounting portion $\mathbf{27}_5$.

An annularly protruding slip-off preventing portion 55 is integrally provided on an inner peripheral surface of the sealing portion $\mathbf{52}_1$ of the elastic membrane $\mathbf{19}_6$, so that it is located inside the reinforcing member 54. The slip-off preventing portion 55 is resiliently engaged into an engage groove 51 provided in the outer surface of the mounting portion $\mathbf{27}_5$ of the occluding member $\mathbf{18}_6$.

Such occluding member $\mathbf{18}_6$ is screwed into the mounting bore 17 with the external threads threadedly engaged with the internal threads 23 in such a manner an annular gasket 33 is sandwiched between the protruding collar $\mathbf{25}_1$ and the boss portion 22. The elastic membrane $\mathbf{19}_6$ is mounted so as not to protrude from the inner surface of the outer wall 11*b* into the cooling water passage 15 in a state in which it has been mounted to the boss portion 22 of the occluding member $\mathbf{18}_6$.

The gasket 33 is interposed between the occluding member $\mathbf{18}_6$ and the boss portion 22 in this embodiment, but if the outer surface of the sealing portion $\mathbf{52}_1$ of the elastic membrane $\mathbf{19}_6$ is in close contact with the inner surface of the mounting bore 17 in a state in which the vibration absorbing means $\mathbf{16}_9$ has been mounted to the engine body E, the gasket 33 may be omitted.

A tool-engaging bottomed bore 56 is provided in the occluding member $\mathbf{18}_6$ to open into the outer end of the occluding member $\mathbf{18}_6$ and to have, for example, a hexagonal cross-sectional shape, so that a tool (not shown) for rotating the occluding member $\mathbf{18}_6$ when the occluding member $\mathbf{18}_6$ is to be screwed into the mounting bore 17 may be engaged into the bore 56. A recess 57 is also provided in the occluding member $\mathbf{18}_6$ to open into an inner end of the occluding member $\mathbf{18}_6$, so as to form the space 20 defined between the elastic membrane $\mathbf{19}_6$ and the occluding member $\mathbf{18}_6$, and a partition wall 58 is provided on the occluding member $\mathbf{18}_6$ for partitioning the tool-engaging bore 56 and the recess 57 from each other.

The partition wall 58 is formed into a disk-shape in a plane perpendicular to the axis of the mounting bore 17, and has its outer periphery integrally connected to an inner periphery of the support tube portion $\mathbf{49}_1$. Moreover, opposite surfaces of the partition wall 58 which define a closed end of the too-engaging bore 56 and a closed end of the recess 57 respectively, are disposed at a central portion of the support tube portion $\mathbf{49}_1$ within an axial region W where the external threads 50 are disposed.

According to the ninth embodiment, the vibration absorbing means $\mathbf{16}_9$ is mounted to the outer wall 11*b* to occlude the mounting bore 17, and includes the occluding member $\mathbf{18}_6$ for occluding the through-bore provided, and the elastic membrane $\mathbf{19}_6$ fixed to the occluding member $\mathbf{18}_6$ with one surface thereof facing the water passage portion 14*a* and with the other surface thereof facing the space 20 defined between the elastic membrane $\mathbf{19}_6$ and the occluding member $\mathbf{18}_6$. Therefore, the variation in pressure of the cooling water is absorbed by the flexing of the membrane portion $\mathbf{53}_1$ of the elastic membrane $\mathbf{19}_6$, whereby an exciting force applied from the cooling water to the outer wall 11*b* is effectively reduced. Moreover, since the space 20 faced by the other surface of the elastic membrane $\mathbf{19}_6$ is covered with the occluding member $\mathbf{18}_6$, a sound caused by the vibration of the elastic membrane $\mathbf{19}_6$ cannot be radiated from the occluding member $\mathbf{18}_6$ to the outside, and a piston slap sound can be effectively reduced.

The occluding member $\mathbf{18}_6$ is screwed into the engine body E, and the operation for mounting and removing the vibration absorbing means $\mathbf{16}_9$ to the engine body E is extremely easy, whereby the replacement and maintenance of the elastic membrane $\mathbf{19}_6$ can be easily carried out.

In addition, the elastic membrane $\mathbf{19}_6$ is press-fitted over and fixed to the occluding member $\mathbf{18}_6$, and as compared with a case where the elastic membrane is secured to the occluding member by baking or adhesion, the reduction in sealability due to the pressure of the water in the cooling water passage 14 or the deterioration of the elastic membrane $\mathbf{19}_6$ can be avoided and the fixed state of the elastic membrane $\mathbf{19}_6$ to the occluding member $\mathbf{18}_6$ can be reliably maintained. Moreover, since the ring-shaped reinforcing member 54 is mounted on the sealing portion $\mathbf{52}_1$ of the elastic membrane $\mathbf{19}_6$, the sealing portion $\mathbf{52}_1$ of the elastic membrane $\mathbf{19}_6$, i.e. the press-fitted portion of the elastic membrane $\mathbf{19}_6$ over the occluding member $\mathbf{18}_6$, is reinforced with the reinforcing member 54. Therefore, when the elastic membrane $\mathbf{19}_6$ is press-fitted, the cylindrical shape of the sealing portion $\mathbf{52}_1$ can be maintained to facilitate the press-fitting operation and the close contact state of the sealing portion $\mathbf{52}_1$ with the outer periphery of the mounting portion $\mathbf{27}_5$ can be reliably maintained to enhance the sealability. In addition, since the reinforcing member 54 is mounted within the sealing portion $\mathbf{52}_1$, so that it is entirely wrapped with the sealing portion $\mathbf{52}_1$, the reinforcing member 54 can be reliably prevented from being fallen from the elastic membrane $\mathbf{19}_6$.

Further, a slip-off preventing portion 55 is provided on the inner surface of the sealing portion $\mathbf{52}_1$, so that it is located inside the reinforcing member 54, and the slip-off preventing portion 55 is resiliently engaged in the engage groove in the mounting portion $\mathbf{27}_5$. Therefore, it is possible to inhibit the falling of the elastic membrane $\mathbf{19}_6$ from the occluding member $\mathbf{18}_6$, to reliably maintain the press-fitted and fixed state of the elastic membrane $\mathbf{19}_6$ to the occluding member $\mathbf{18}_6$, and to firmly maintain the engaged state of the slip-off preventing portion 55 in the engage groove 51.

Moreover, in press-fitting the sealing portion $\mathbf{52}_1$ of the elastic membrane $\mathbf{19}_6$ over the outer periphery of the mounting portion $\mathbf{27}_5$, the sealing portion $\mathbf{52}_1$ is press-fitted until the press-fitting of the sealing portion $\mathbf{52}_1$ is limited by the limiting portion 28 provided on the occluding member $\mathbf{18}_6$ for limiting the end of the movement of the sealing portion $\mathbf{52}_1$ in the press-fitting direction. Therefore, it is possible to sufficiently ensure the sealability of the elastic membrane $\mathbf{19}_6$, while enhancing the press-fitting operability.

Further, since the elastic membrane $\mathbf{19}_6$ does not protrude from the inner surface of the outer wall 11*b* into the cooling water passage 14, it is possible to avoid, to the utmost, that the flowing of the cooling water through the cooling water passage 14 is hindered by the elastic membrane $\mathbf{19}_6$, to smoothen the flowing of the cooling water through the cooling water passage 14, and to maintain the cooling performance to the same extent as in the conventional water-cooled internal combustion engine which is not provided with the vibration absorbing means $\mathbf{16}_9$.

Yet further, the occluding member $\mathbf{18}_6$ is provided with the tool-engaging bore 56 opening into the outer end of the occluding member $\mathbf{18}_6$, and the recess 57 opening into the inner end of the occluding member $\mathbf{18}_6$ and defined to form the space 20. Therefore, a tool can be engaged into the tool-engaging bore 56 to turn the occluding member $\mathbf{18}_6$, thereby simply screwing the occluding member $\mathbf{18}_6$ into the mounting bore 17, and the volume of the space 20 can be sufficiently ensured by the recess 57.

Moreover, since the opposite surfaces of the partition wall 58 defining the closed end of the tool-engaging bore 56 and the closed end of the recess 57 respectively are disposed on the support tube portion $\mathbf{49}_1$ within the axial region W where the external threads 50 are disposed, portions of the tool-engaging bore 56 and the recess 57 are disposed within the axial region W. Therefore, it is possible to avoid, to the utmost, that the tool-engaging bore 56 and the recess 57 are disposed at locations axially different from the support tube portion $\mathbf{49}_1$, thereby providing the compactness of the occluding member $\mathbf{18}_6$ and reducing the weight of the occluding member $18_6$ by an amount corresponding to the provision of the tool-engaging bore 56 and the recess 57.

Additionally, since the outer periphery of the partition wall $58_1$ is connected to the inner periphery of the support tube portion $49_1$, the rigidity of the support tube portion $49_1$ screwed in the mounting bore 17 can be enhanced. Further, since the partition wall 58 is disposed at the central portion within the axial region W, the rigidity of the support tube portion $49_1$ can be further enhanced.

When the elastic membrane $19_6$ is mounted to the occluding member $18_6$, there is a possibility that the elastic membrane $19_6$ is expanded toward the cooling water passage 14 due to the increase in pressure in the space 20 defined between the elastic membrane $19_6$ and the occluding member $18_6$, whereby the vibrating characteristic of the elastic membrane $19_6$ is changed, resulting in a reduced vibration absorbing effect. When the amount of elastic membrane $19_6$ expanded toward the cooling water passage 14 is larger, there is also a possibility that the flowing of the cooling water through the cooling water passage 14 is hindered. However, the membrane portion $53_1$ of the elastic membrane $19_6$ is of the shape such that it is curved toward the occluding member $18_6$ in the natural state with no external force applied thereto, i.e., before amounting of the elastic membrane $19_6$ to the occluding member $18_6$, as shown in FIG. 14, and hence, even if the pressure in the space 20 closed upon the mounting of the elastic membrane $19_6$ to the occluding member $18_6$ is increased, it can be avoided that the elastic membrane $19_6$ is expanded toward the cooling water passage 14, whereby an excellent vibration absorbing effect can be obtained, and the flowing of the cooling water in the cooling water passage 14 cannot be hindered.

Figure 15:
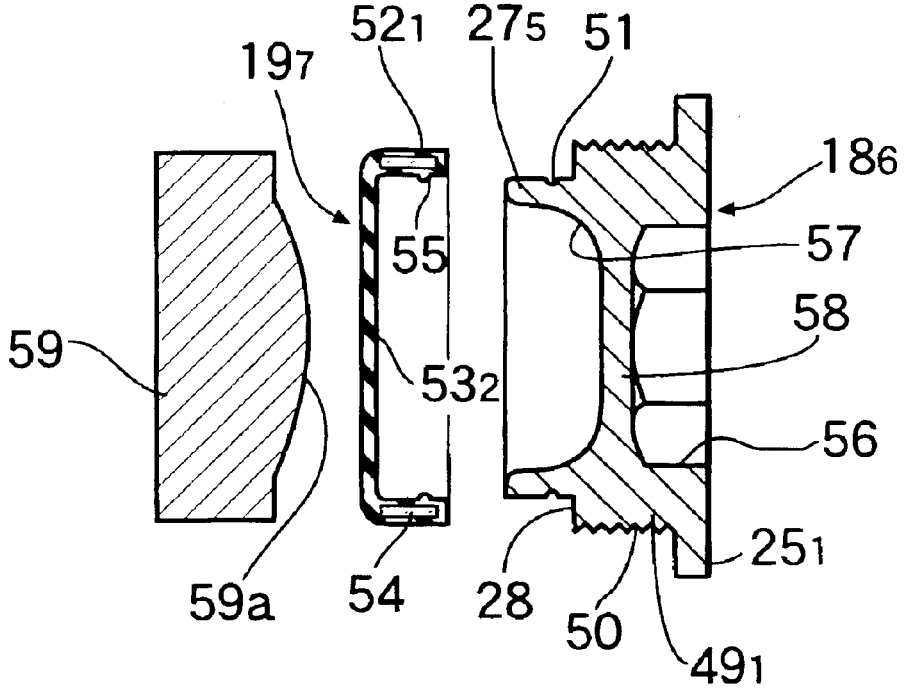
Figure 16:
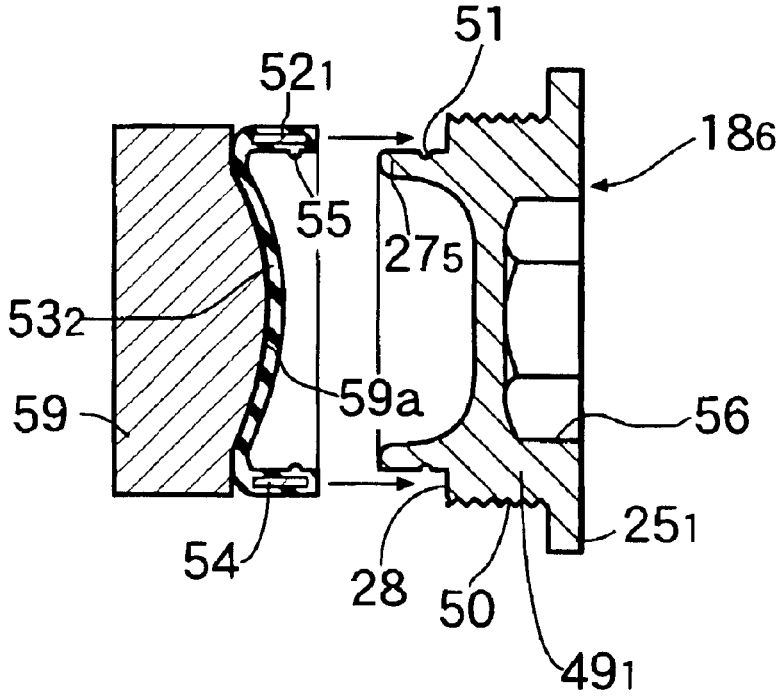

FIGS. 15 and 16 show a tenth embodiment of the present invention. FIG. 15 is a vertical sectional view showing a state in which no external force is applied to an elastic membrane before press-fitting of the elastic membrane over an occluding member, and FIG. 16 is a vertical sectional view showing a state in which an urging force has been applied to the elastic membrane by an urging member before press-fitting of the elastic membrane over the occluding member.

The elastic membrane $19_7$ press-fitted over and fixed to the occluding member $18_6$ is formed into a cap-shape and comprised of a cylindrical sealing portion $52_1$ which is press-fitted over an outer periphery of a mounting portion $27_5$ of the occluding member $18_6$, and a membrane portion $53_2$ connected to the other end of the sealing portion $52_1$ to define a space 20 (see FIG. 13) between the membrane portion $53_2$ and the occluding member $18_6$.

Such elastic membrane $19_7$ is press-fitted over and fixed to the occluding member $18_6$ by pressing it by the urging member 59 and moreover, the membrane portion $53_2$ of the elastic membrane $19_7$ is formed into a flat disk-shape, as shown in FIG. 15, in a natural state with no external force applied thereto by the urging member 59. In addition, the urging member 59 has a spherical urging face 59*a* protruding toward the occluding member $18_6$, and when the elastic membrane $19_7$ is urged by the urging member 59, the membrane portion $53_2$ of the elastic membrane $19_7$ is curved toward the occluding member $18_6$, as shown in FIG. 16. In other words, the elastic membrane $19_7$ is assembled to the occluding member $18_6$, whole being urged by the urging member 59, so that its membrane portion $53_2$ is curved toward the occluding member $18_6$.

According to the tenth embodiment, the elastic membrane $19_7$ is assembled to the occluding member $18_6$ in a state in which it has been forcibly curved toward the occluding member $18_6$. Therefore, it is possible to avoid that the pressure in the space 20 is largely increased in such a manner that air is eliminated by the portion of the elastic membrane $19_7$ curved toward the space 20 (see FIG. 13); to prevent the elastic membrane $19_7$ from being curved so that it protrudes toward the cooling water passage 14 after assembling thereof to the occluding member $18_6$; and to provide an effect similar to that in the ninth embodiment.

Figure 17:
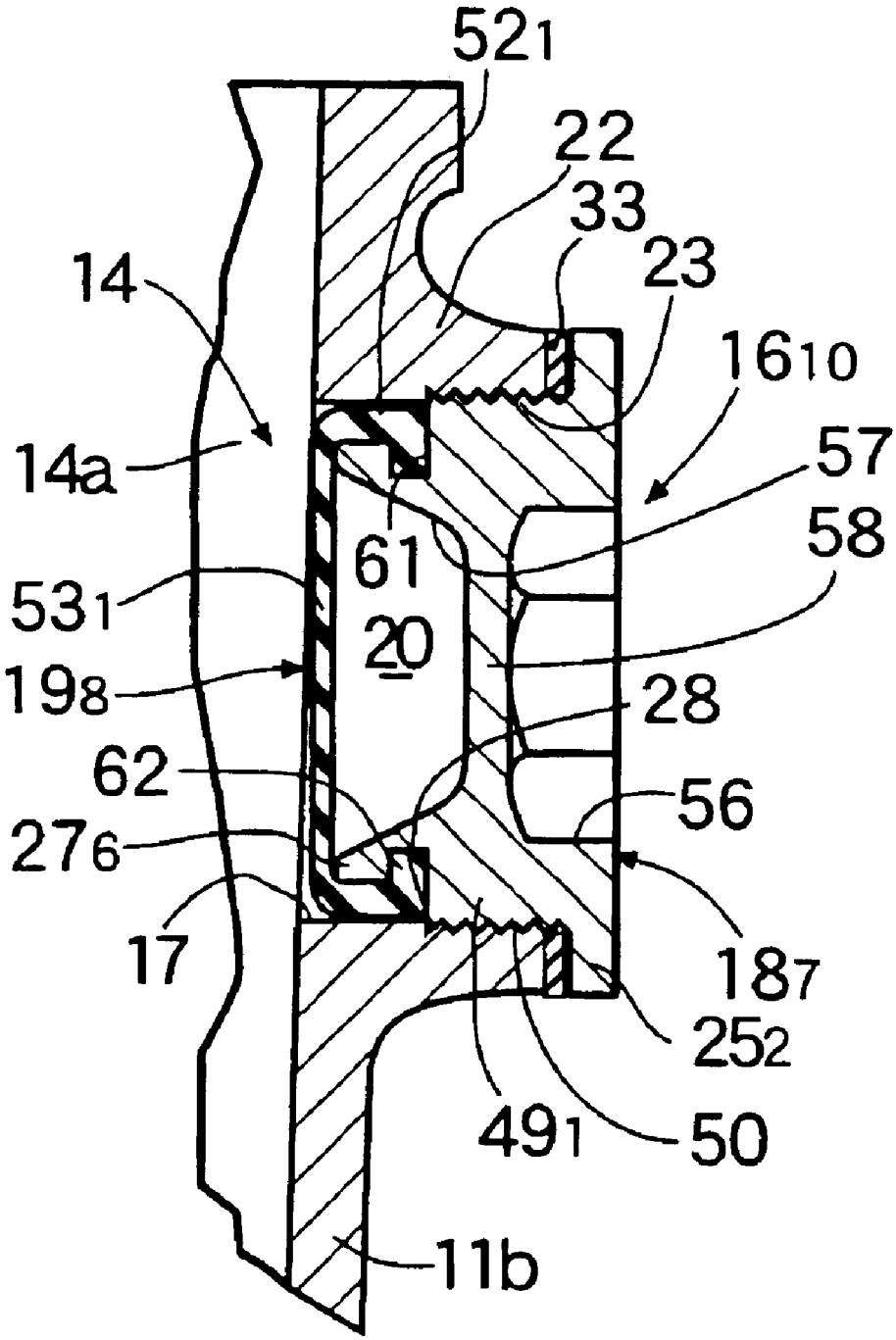
FIG. 17 is a sectional view similar to FIG. 3, but according to an eleventh embodiment of the present invention.

FIG. 17 shows an eleventh embodiment of the present invention, wherein portions or components corresponding to those in each of the previous embodiments are designated by like reference characters.

A vibration absorbing means $16_{10}$ includes an occluding member $18_7$ for occluding the through-bore 17, and an elastic membrane $19_8$ press-fitted over and fixed to the occluding member $18_7$ with one surface thereof facing the water passage portion 14*a* of the liquid passage 14 and with the other surface thereof facing a space 20 defined between the elastic membrane $19_8$ and the occluding member $18_7$.

The occluding member $18_7$ is formed from a metal material having a rigidity and integrally provided with (1) a support tube portion $49_1$ having external threads 50 on an outer periphery thereof, which are threadedly engaged with the internal threads 23 of the through-bore 17, (2) a protrusion collar $25_1$ protruding radially outwards from an outer end of the support tube portion $49_1$, and (3) a cylindrical mounting portion $27_6$ coaxially protruding from an inner end of the support tube portion $49_1$ with a limiting portion as an annular stepped face being formed between the mounting portion $27_6$ and the support tube portion $49_1$. An annular recess 61 is provided around an outer periphery of a base end of the mounting portion $27_6$.

On the other hand, the elastic membrane $19_8$ is made, for example, of an ethylene-based or propylene-based rubber, and includes a cylindrical sealing portion $52_1$ press-fitted over an outer periphery of the mounting portion $27_6$ of the occluding member $18_7$ with one end thereof abutting against the limiting portion 28, a membrane portion $53_1$ connected to the other end of the sealing portion $52_1$ to define a space 20 between the membrane portion $53_1$ and the occluding member $18_7$, and a collar-shaped slip-off preventing portion 62 protruding radially inwards from one end of the sealing portion $52_1$ to resiliently engage the annular recess 61 in the mounting portion $27_6$.

Moreover, in the elastic membrane $19_8$, the thickness of the sealing portion $52_1$ and the slip-off preventing portion 62 is set larger than that of the membrane portion $53_1$, whereby the rigidities of the sealing portion $52_1$ and the slip-off preventing portion 62 are relatively large.

According to the eleventh embodiment, the rigidities of the sealing portion $52_1$ and the slip-off preventing portion 62 of the elastic membrane $19_8$ can be increased to the relatively large values without use of a reinforcing member 54 as used in the ninth and tenth embodiments, and the press-fitted state of the sealing portion $52_1$ over the mounting portion $27_6$ can be firmly maintained. In addition, since the slip-off preventing portion 62 is in resilient engagement in the annular recess 61, the falling of the elastic membrane $19_8$ from the occluding member $18_7$ can be inhibited, whereby the press-fitted and fixed state of the elastic membrane $19_8$ over the occluding member $18_7$ can be reliably maintained.

Figure 18:
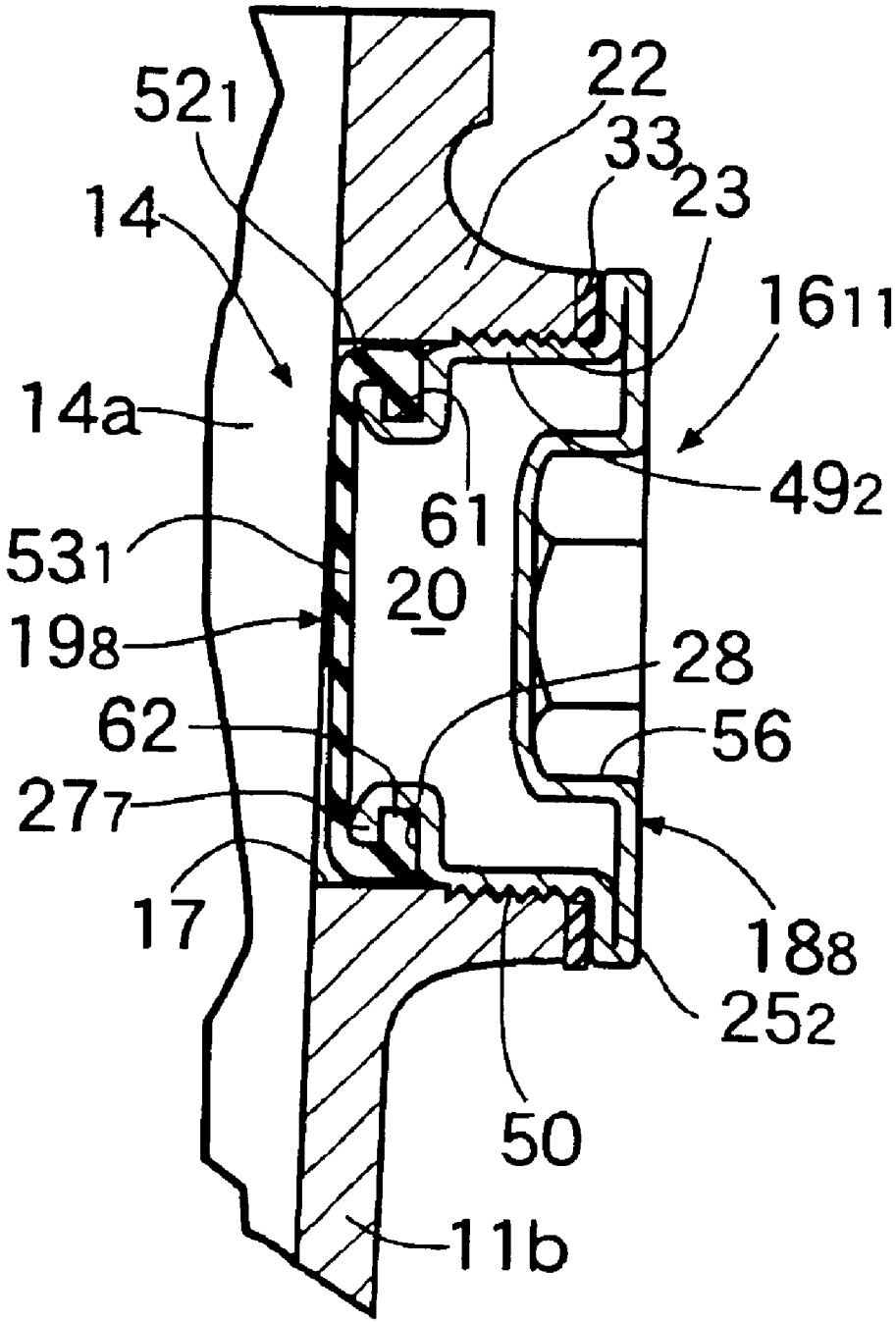
FIG. 18 is a sectional view similar to FIG. 3, but according to a twelfth embodiment of the present invention.

FIG. 18 shows a twelfth embodiment of the present invention, wherein portions or components corresponding to those in each of the previous embodiments are designated by like reference characters.

A vibration absorbing means $16_{11}$, includes an occluding member $18_8$ for occluding the through-bore 17, and an elastic membrane $19_8$ press-fitted over and fixed to the occluding member $18_8$ with one surface thereof facing the water passage portion 14*a* of the cooling water passage 14 and with the other surface thereof facing a space 20 defined between the elastic membrane $19_8$ and the occluding member $18_8$.

The occluding member $18_8$ is formed from a metal material having a rigidity by pressing a metal plate such as JIS SP or the like, and integrally provided with (1) a support tube portion $49_2$ having external threads 50 around an outer periphery thereof, which are threadedly engaged with the internal threads 23 of the through-bore 17, (2) a protrusion collar $25_2$ protruding radially outwards from an outer end of the support tube portion $49_2$, and (3) a cylindrical mounting portion $27_7$ coaxially protruding from an inner end of the support tube portion $49_2$ with a limiting portion 28 as an annular stepped face being formed between the mounting portion $27_7$ and the support tube portion $49_2$. An engage recess 56 is defined at an outer end of the occluding member $18_8$, and an annular recess 61 is provided around an outer periphery of a base end of the mounting portion $27_7$.

The sealing portion $52_1$ of the elastic membrane $19_8$ is press-fitted over the outer periphery of the mounting portion $27_7$ of the occluding member $18_8$ with one end thereof abutting against the limiting portion 28, and the annular recess 61 of the mounting portion $27_7$ is resiliently engaged with the slip-off preventing portion 62.

According to the twelfth embodiment, since the occluding member $18_8$ is formed by pressing the metal plate, reductions in weight of the occluding member $18_8$ , i.e., the vibration absorbing means $16_{11}$ can be provided. Thus, it is possible to avoid a variation in vibration mode on the surface of the cylinder block 11 due to the mounting of the vibration absorbing means $16_{11}$ and to provide a sufficient piston slap sound reducing effect.

Figure 19:
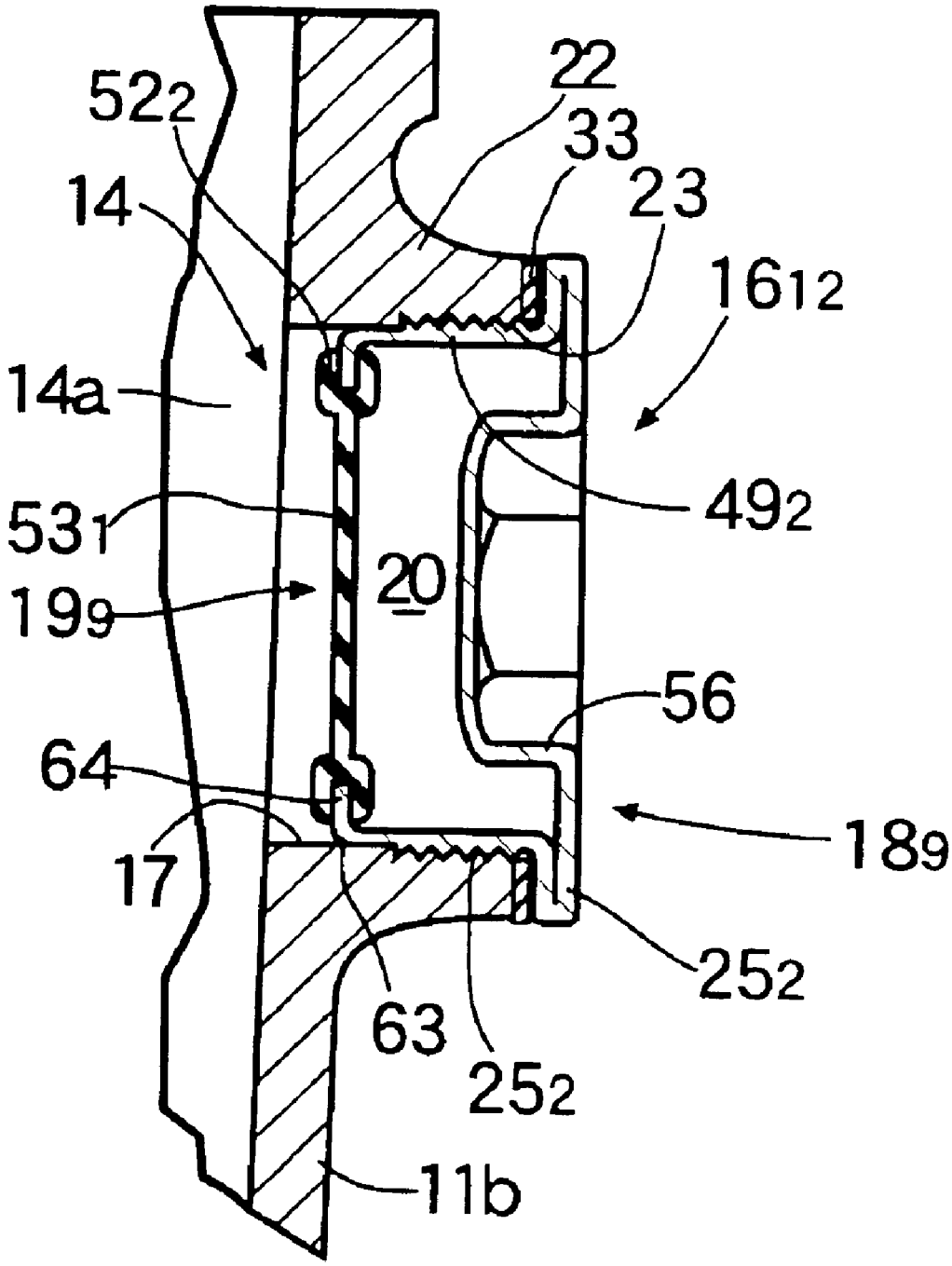
FIG. 19 a sectional view similar to FIG. 3, but according to a thirteenth embodiment of the present invention.

FIG. 19 shows a thirteenth embodiment of the present invention, wherein portions or components corresponding to those in each of the previous embodiments are designated by like reference characters.

A vibration absorbing means $16_{12}$ includes an occluding member 189 for occluding the through-bore 17, and an elastic membrane $19_9$ press-fitted over and fixed to the occluding member $18_9$ with one surface thereof facing the water passage portion 14*a* of the cooling water passage 14 and with the other surface thereof facing a space 20 defined between the elastic membrane $19_9$ and the occluding member $18_9$.

The occluding member $18_9$ is formed from a metal material having a rigidity by pressing a metal plate such as JIS SP or the like, and integrally provided with (1) a support tube portion $49_2$ having external threads 50 around an outer periphery thereof, which are threadedly engaged with the internal threads 23 of the through-bore 17, (2) a protrusion collar $25_2$ protruding radially outwards from an outer end of the support tube portion $49_2$. (3) a cylindrical extended tube portion 63 coaxially connected to a front end of the support tube portion $49_2$, and (4) a protrusion collar 64 protruding radially inwards from a front end of the extended tube portion 63. An engage recess 56 is defined at an outer end of the occluding member $18_9$.

On the other hand, the elastic membrane $19_9$ includes a disk-shaped membrane portion $53_1$ which defines a space 20 between the membrane portion $53_1$ and the occluding member $18_9$, and a sealing portion $52_2$ is provided around the entire outer periphery of the membrane portion $53_1$. The sealing portion $52_2$ is formed to have a substantially U-shaped cross-sectional shape in which it opens toward the collar 64, so that it is press-fitted over the collar 64 of the occluding member $18_9$.

Even according to the thirteenth embodiment, an effect similar to that in each of the previous embodiments can be provided by press-fitting and fixing of the elastic membrane $19_9$ to the occluding member $18_9$.

Figure 20:
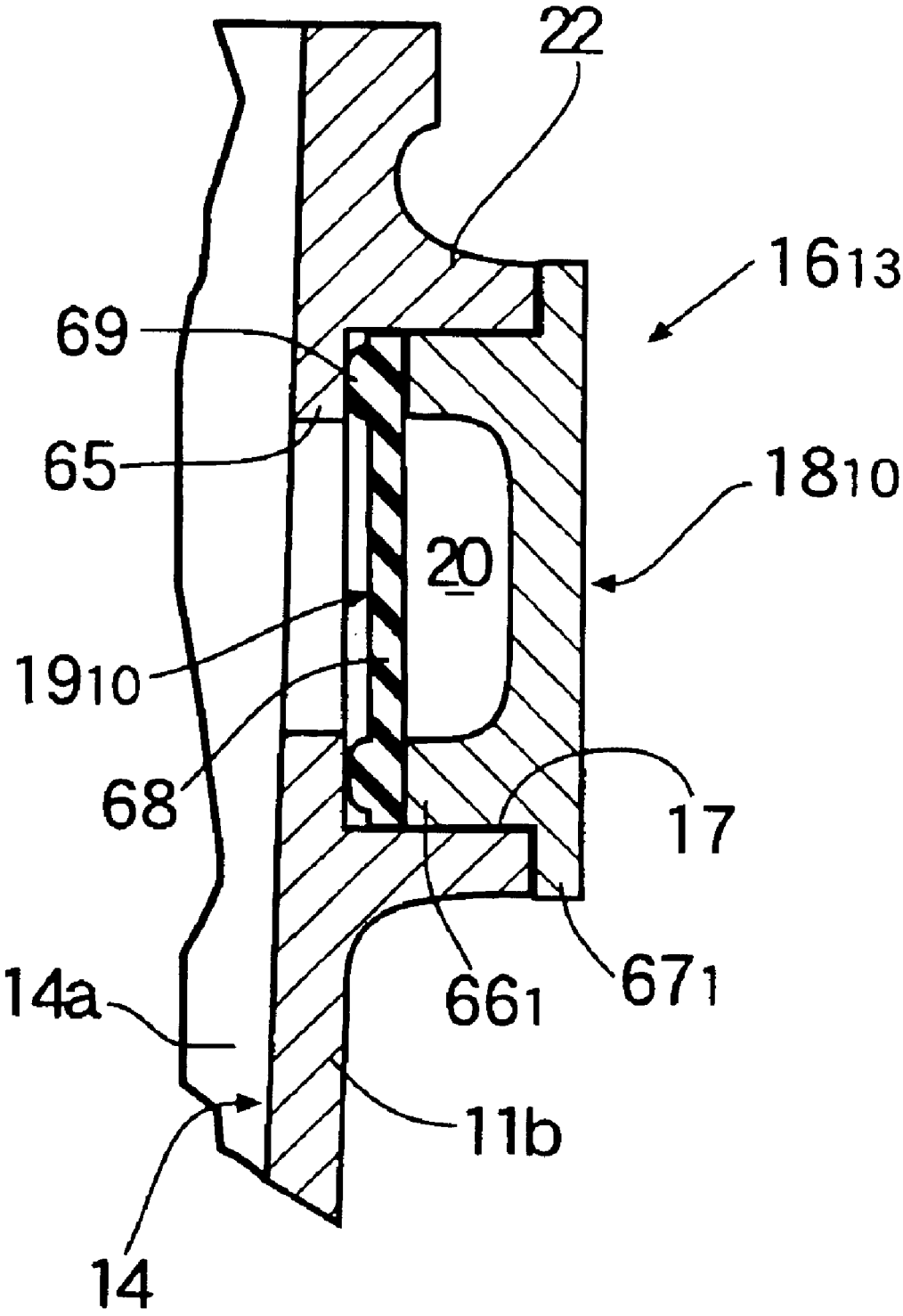
FIG. 20 a sectional view similar to FIG. 3, but according to a fourteenth embodiment of the present invention.

FIG. 20 shows a fourteenth embodiment of the present invention, wherein portions or components corresponding to those in each of the previous embodiments are designated by like reference characters.

The outer wall 11*b* is provided with a through-bore 17 with its inner end opening into the water passage portion 14*a*, and a collar-shaped receiving portion 65 protruding inwards from an inner surface of an inner end of the through-bore 17.

A vibration absorbing means $16_{13}$ includes an occluding member $18_{10}$ for occluding the through-bore 17, and an elastic membrane $19_{10}$ clamped between the receiving portion 65 and the occluding member $18_{10}$ with one surface thereof facing the water passage portion 14*a* of the cooling water passage 14 and with the other surface thereof facing a space 20 defined between the elastic membrane $19_{10}$ and the occluding member $18_{10}$.

The occluding member $18_{10}$ is formed from a metal material having a rigidity, e.g., an aluminum alloy, and integrally provided with a cylindrical portion $66_1$ with its outer end closed, and a limiting collar portion $67_1$ radially outwards from the outer end of the cylindrical portion $66_1$. The occluding member $18_{10}$ is fixedly mounted to the outer wall 11*b* to occlude the through-bore 17 by press-fitting of the cylindrical portion $66_1$ into the through-bore 17 from the outside. Thus, the end of the press-fitting movement of the occluding member $18_{10}$ toward the receiving portion 65 is limited by abutment of the limiting collar portion $67_1$ of the occluding member $18_{10}$ against the outer end of the boss portion 22.

The elastic membrane $19_{10}$ is made, for example, of an ethylene-based or propylene-based rubber, and comprises an annular lip 69 integrally provided in a projecting manner on an outer periphery of a disk-shaped membrane portion 68 inserted into the through-bore 17. The outer periphery of the elastic membrane $19_{10}$ is clamped to crush the lip 69 between a tip end of the cylindrical portion $66_1$ of the occluding member $18_{10}$ and the receiving portion 65 by press-fitting of the occluding member $18_{10}$ into the through-bore 17. One end of the elastic membrane $19_{10}$ in a state in which it has been clamped between the occluding member $18_{10}$ and receiving portion 65, faces the water passage portion 14*a* of the cooling water passage 14, while the other end of the elastic membrane $19_{10}$ faces the space 20 defined between the elastic membrane $19_{11}$ and the occluding membrane $18_{10}$.

According to the fourteenth embodiment, a variation in pressure of cooling water is absorbed by flexing of the membrane portion 68 of the elastic membrane $19_{10}$, and an exiting force applied from the cooling water to the outer wall 11*b* of the cylinder block 11 is effectively reduced. Moreover, the space faced by the other surface of the elastic membrane $19_{10}$ is covered with the occluding member $18_{10}$ and hence, a sound caused by the vibration of the elastic membrane $19_{10}$ cannot be radiated from the occluding member $18_{10}$ to the outside, and a piston slap sound radiated from the cylinder block 11 can be effectively reduced.

The entire outer periphery of the elastic membrane $19_{10}$ is clamped between the occluding member $18_{10}$ and the receiving portion 65. Thus, it can be avoided that the sealability is reduced due to the water pressure in the cooling water passage 14 or due to the deterioration of the elastic membrane $19_{10}$, and the elastic membrane $19_{10}$ can be reliably clamped between the occluding member $18_{10}$ and the receiving portion 65, thereby ensuring the excellent sealability, as compared with a vibration absorbing means including an elastic membrane secured directly to an occluding member by baking or adhesion.

Moreover, the space cannot be surrounded by the cooling water in the cooling water passage 14 and hence, it is possible to avoid the variation in vibration characteristic of the elastic membrane $19_{10}$ with a variation in temperature of the cooling water, thereby stabilizing the vibration characteristic to provide an excellent vibration absorbing effect during operation of the engine.

In addition, the annular lip 69 is provided on the outer periphery of the elastic membrane $19_{10}$ to come into close contact with the receiving portion 65, and the limiting collar portion $67_1$ abutting against the outer end of the boss portion 22 to limit the end of the movement of the occluding member $18_{10}$ toward the receiving portion 65, i.e., the movement of the occluding member $18_{10}$ in the press-fitting direction is integrally provided on the occluding member $18_{10}$ clamping the entire periphery of the elastic membrane $19_{10}$ between the occluding member $18_{10}$ and the receiving portion 65. Therefore, it is possible to enhance the sealability in a manner to crush the lip 69, and it is possible to determine the crushing margin at a preset value by the abutment of the limiting collar portion $67_1$ against the outer end of the boss portion 22. Thus, it is possible to eliminate the need for the press-fitting of the occluding member $18_{10}$ into the through-bore 17 to enhance the assemblability, while taking the crushing margin of the lip 69 into consideration.

Further, since the elastic membrane $19_{10}$ does not protrude from the inner surface of the outer wall 11*b* of the cylinder block 11 into the cooling water passage 14, it is possible to avoid, to the utmost, that the flowing of the cooling water in the cooling water passage 14 is hindered by the elastic membrane $19_{10}$; to smoothen the flowing of the cooling water in the cooling water passage 14; and to maintain the cooling performance to the same extent as in the conventional water-cooled internal combustion engine which is not provided with the vibration absorbing means $16_{13}$.

Figure 21:
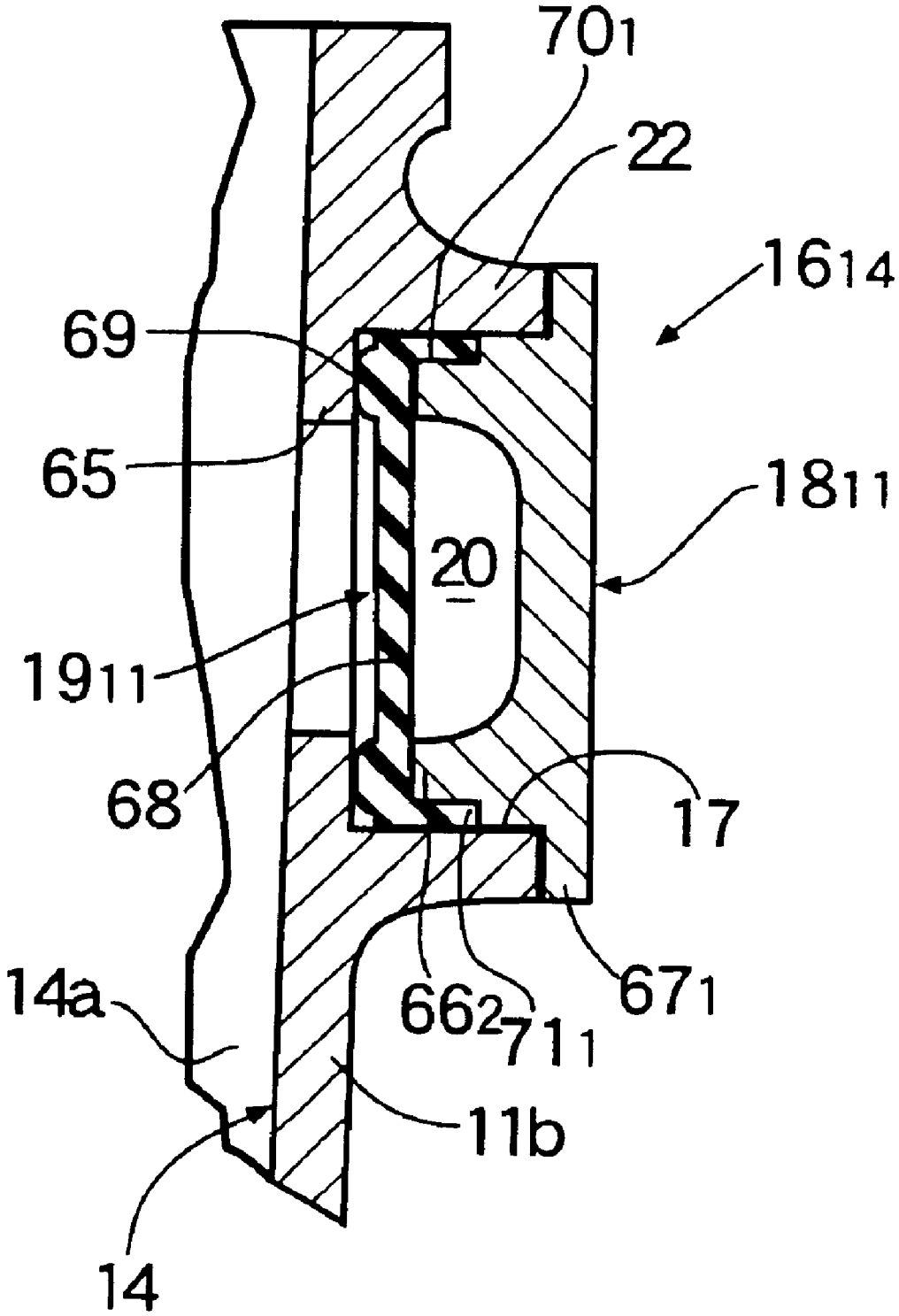
FIG. 21 a sectional view similar to FIG. 3, but according to a fifteenth embodiment of the present invention.

FIG. 21 shows a fifteenth embodiment of the present invention, wherein portions or components corresponding to those in each of the previous embodiments are designated by like reference characters.

The outer wall 11*b* is provided with a through-bore 17 and a receiving portion 65 which protrudes radially inwards from an inner surface of an inner end of the through-bore 17. A vibration absorbing means $16_{14}$ is mounted to the outer wall 11*b* to occlude the through-bore 17. The vibration absorbing means $16_{14}$ includes an occluding member $18_{11}$ for occluding the through-bore 17, and an elastic membrane $19_{11}$ clamped between the receiving portion 65 and the occluding member $18_{11}$ with one surface thereof facing the water passage portion 14*a* of the cooling water passage 14 and with the other surface thereof facing a space 20 defined between the elastic membrane $19_{11}$ and the occluding member $18_{11}$.

The occluding member $18_{11}$ is formed from a metal material having a rigidity such as an aluminum alloy, and integrally provided with a cylindrical portion $66_2$ with its outer end closed, and a limiting collar $67_1$ protruding radially outwards from the outer end of the cylindrical portion $66_2$. The cylindrical portion $66_2$ is press-fitted into the through-bore 17 in such a manner that the limiting collar $67_1$ abuts against the outer end of the boss portion 22. Moreover, an annular recess $70_1$ is defined in an outer periphery of a tip end of the cylindrical portion $66_2$.

On the other hand, the elastic membrane $19_{11}$ is comprised of an annular lip 69 integrally and protrudingly provided on an outer periphery of a disk-shaped membrane portion 68 to protrude therefrom, and a cylindrical engage portion $71_1$ integrally connected to the outer periphery of the membrane portion 68 and resiliently fitted into the annular recess $70_1$ in the occluding member $18_{11}$.

According to the fifteenth embodiment, in addition to the effect in the fourteenth embodiment, it is possible to reliably prevent the elastic membrane $19_{11}$ from falling from between the receiving portion 65 and the occluding member $18_{11}$ by resilient fitting of the engage portion $71_1$ over the occluding member $18_{11}$, and it is further possible to mount the vibration absorbing means $16_{14}$ to the outer wall 11*b* in a state in which the elastic membrane $19_{11}$ has been mounted to the occluding member $18_{11}$, leading to a facilitated assembling operation.

Figure 22:
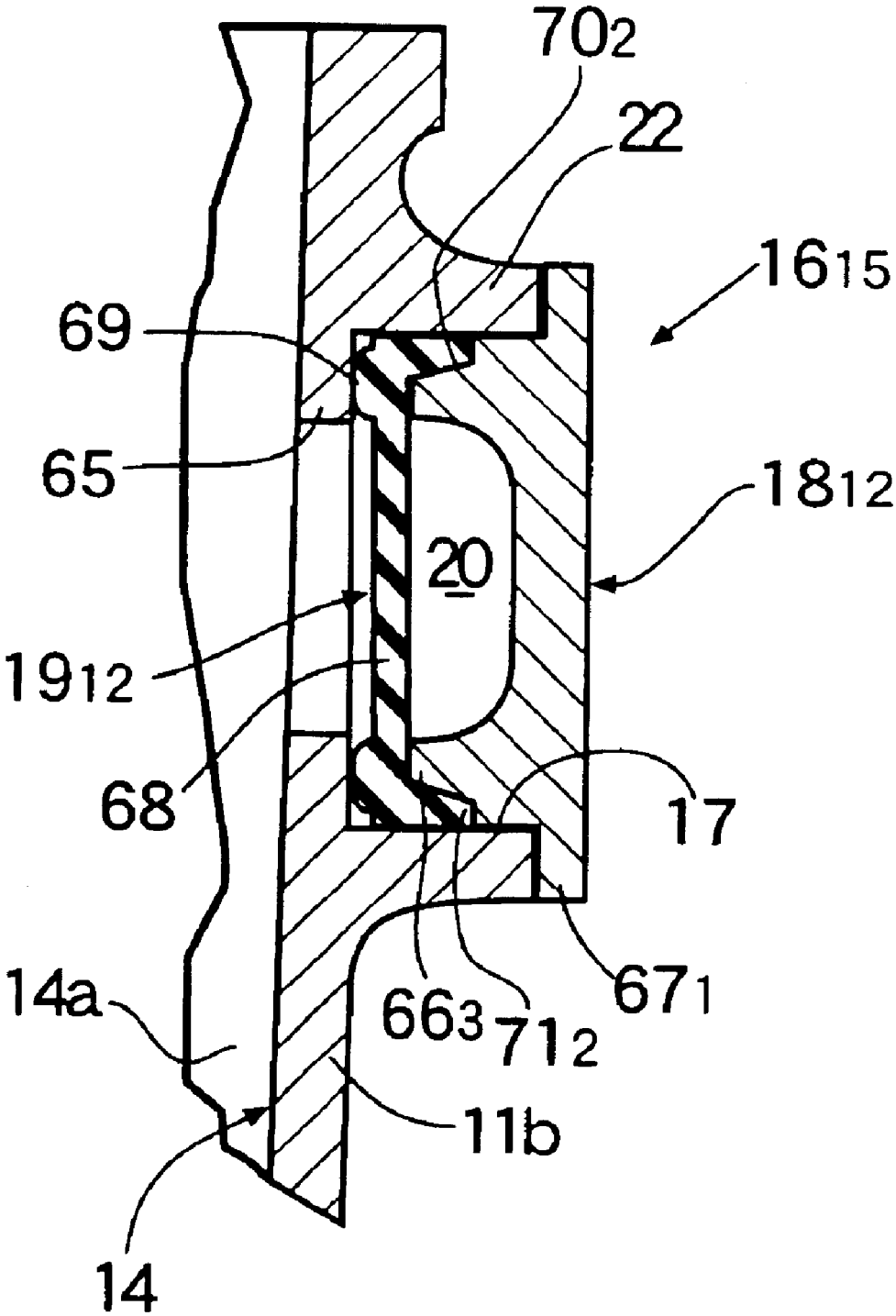
FIG. 22 a sectional view similar to FIG. 3, but according to a sixteenth embodiment of the present invention.

FIG. 22 shows a sixteenth embodiment of the present invention, wherein portions or components corresponding to those in each of the previous embodiments are designated by like reference characters.

The outer wall 11*b* is provided with a through-bore 17, and a receiving portion 65 which protrudes radially inwards from an inner surface of an inner end of the through-bore 17. A vibration absorbing means $16_{15}$ is mounted to the outer wall 11*b* to occlude the through-bore 17. The vibration absorbing means $16_{15}$ includes an occluding member $18_{12}$ for occluding the through-bore 17, and an elastic membrane $19_{12}$ clamped between the receiving portion 65 and the occluding member $18_{12}$ with one surface thereof facing the water passage portion 14*a* of the cooling water passage 14 and with the other surface thereof facing a space 20 defined between the elastic membrane $19_{12}$ and the occluding member $18_{12}$.

The occluding member $18_{12}$ includes a cylindrical portion $66_3$ press-fitted into the through-bore 17, and a limiting collar $67_1$ protruding radially outwards from an outer end of the cylindrical portion $66_2$ to abut against the outer end of the boss portion 22. A tapered annular recess $70_2$ which is reduced in diameter toward the receiving portion 65 is defined in an outer periphery of a tip end of the cylindrical portion $66_3$.

On the other hand, the elastic membrane $19_{11}$ is comprised of an annular lip 69 integrally and protrudingly provided on an outer periphery of a disk-shaped membrane portion 68 to protrude therefrom, and a cylindrical engage portion $71_2$ integrally connected to the outer periphery of the membrane portion 68 and resiliently fitted into the annular recess $70_2$ in the occluding member $18_{12}$. The inner surface of the engage portion $71_2$ is formed into a tapered shape in correspondence to the annular recess $70_2$.

According to the sixteenth embodiment, it is possible to reliably prevent the elastic membrane $19_{12}$ from falling from between the receiving portion 65 and the occluding member $18_{12}$ by resilient fitting of the engage portion $71_2$ over the occluding member $18_{12}$, and it is further possible to mount the vibration absorbing means $16_{15}$ to the outer wall 11*b* in a state in which the elastic membrane $19_{12}$ has been mounted to the occluding member $18_{12}$, leading to a facilitated assembling operation. Further, the tapered engage portion $71_2$ is resiliently fitted in the tapered annular recess $70_2$ and hence, it is possible to facilitate the mounting of the elastic membrane $19_{12}$ to the occluding member $18_{12}$ by fitting the cylindrical portion $66_3$ of the occluding member $18_{12}$ in the engage portion $71_2$ in such a manner that the elastic membrane $19_{12}$ does not damage the cylindrica portion $66_3$ Of the occluding member $18_{12}$. Moreover, the inner surface of the engage portion $71_2$ of the elastic membrane $19_{12}$ is brought into close contact with the annular recess $70_2$ to exhibit as resilient force and therefore, the inner surface of the engage portion $71_2$ can be brought into close contact with the entire surface of the annular recess $70_2$ to further enhance the sealability.

Figure 23:
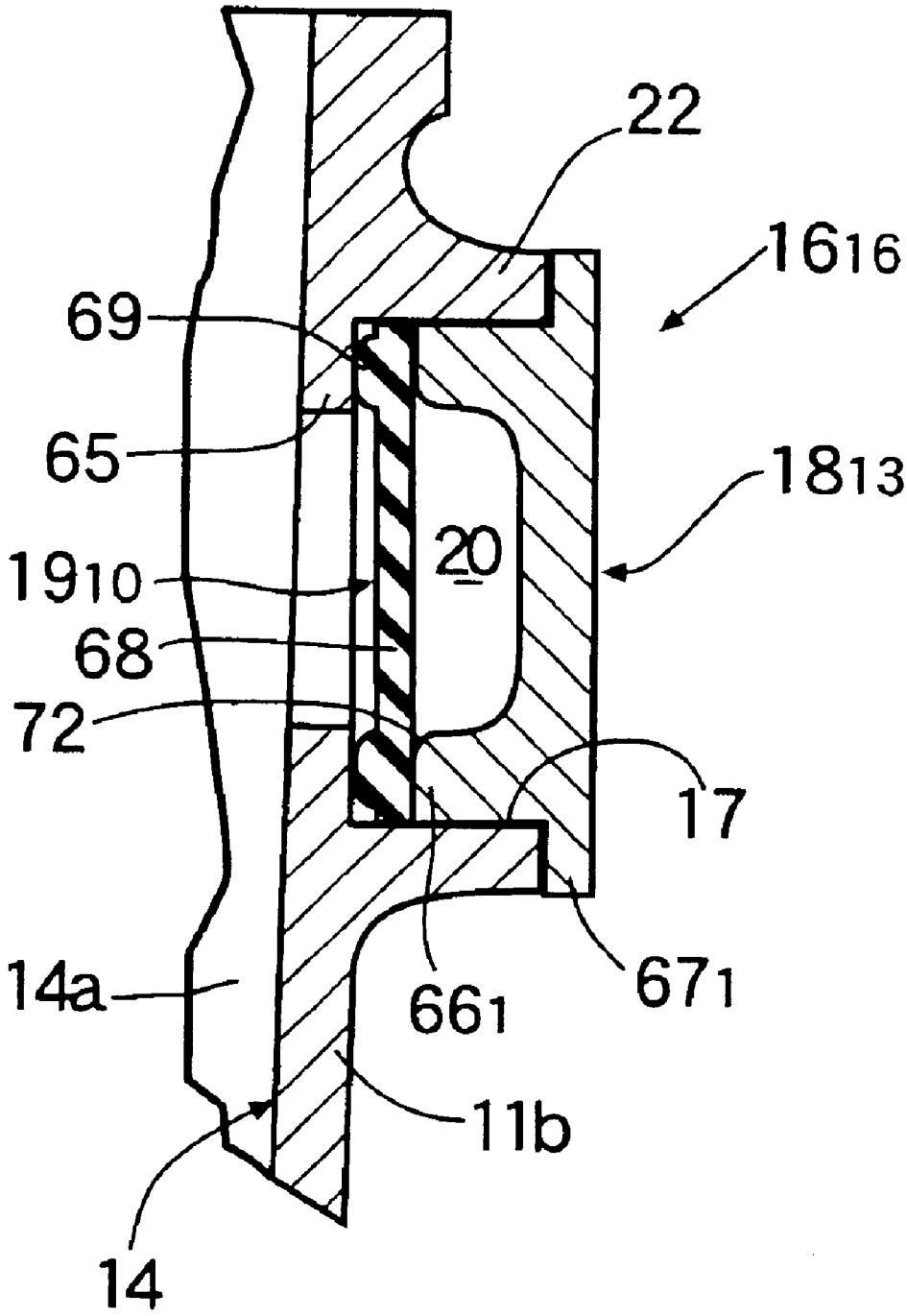
FIG. 23 a sectional view similar to FIG. 3, but according to a seventeenth embodiment of the present invention.

FIG. 23 shows a seventeenth embodiment of the present invention, wherein portions or components corresponding to those in each of the previous embodiments are designated by like reference characters.

The outer wall 11*b* is provided with a through-bore 17, and a receiving portion 65 which protrudes radially inwards from an inner surface of an inner end of the through-bore 17. A vibration absorbing means $16_{16}$ is mounted to the outer wall 11*b* to occlude the through-bore 17. The vibration absorbing means $16_{16}$ includes an occluding member $18_{13}$ for occluding the through-bore 17, and an elastic membrane $19_{10}$ clamped between the receiving portion 65 and the occluding member $18_{13}$ with one surface thereof facing the water passage portion 14*a* of the cooling water passage 14 and with the other surface thereof facing a space 20 defined between the elastic membrane $19_{10}$ and the occluding member $18_{13}$.

The occluding member $18_{13}$ includes a cylindrical portion $66_1$ press-fitted into the through-bore 17, and a limiting collar $67_1$ protruding radially outwards from an outer end of the cylindrical portion $66_1$ to abut against the outer end of the boss portion 22. A smoothly curved chamfered portion 72 is formed on an inner periphery of a tip end of the cylindrical portion $66_1$.

According to the seventeenth embodiment, when a central portion of a membrane portion 68 of the elastic membrane $19_{10}$ is expanded so that it is curved toward the space 20, the chamfered portion 72 is brought into contact with that portion of the membrane portion 68 of the elastic membrane $19_{10}$ which corresponds to the inner periphery of the tip end of the cylindrical portion $66_1$. Thus, it is possible to prevent the membrane portion 68 from being damaged by the contact of the chamfered portion 72 with the inner periphery of the tip end of the cylindrical portion $66_1$.

Figure 24:
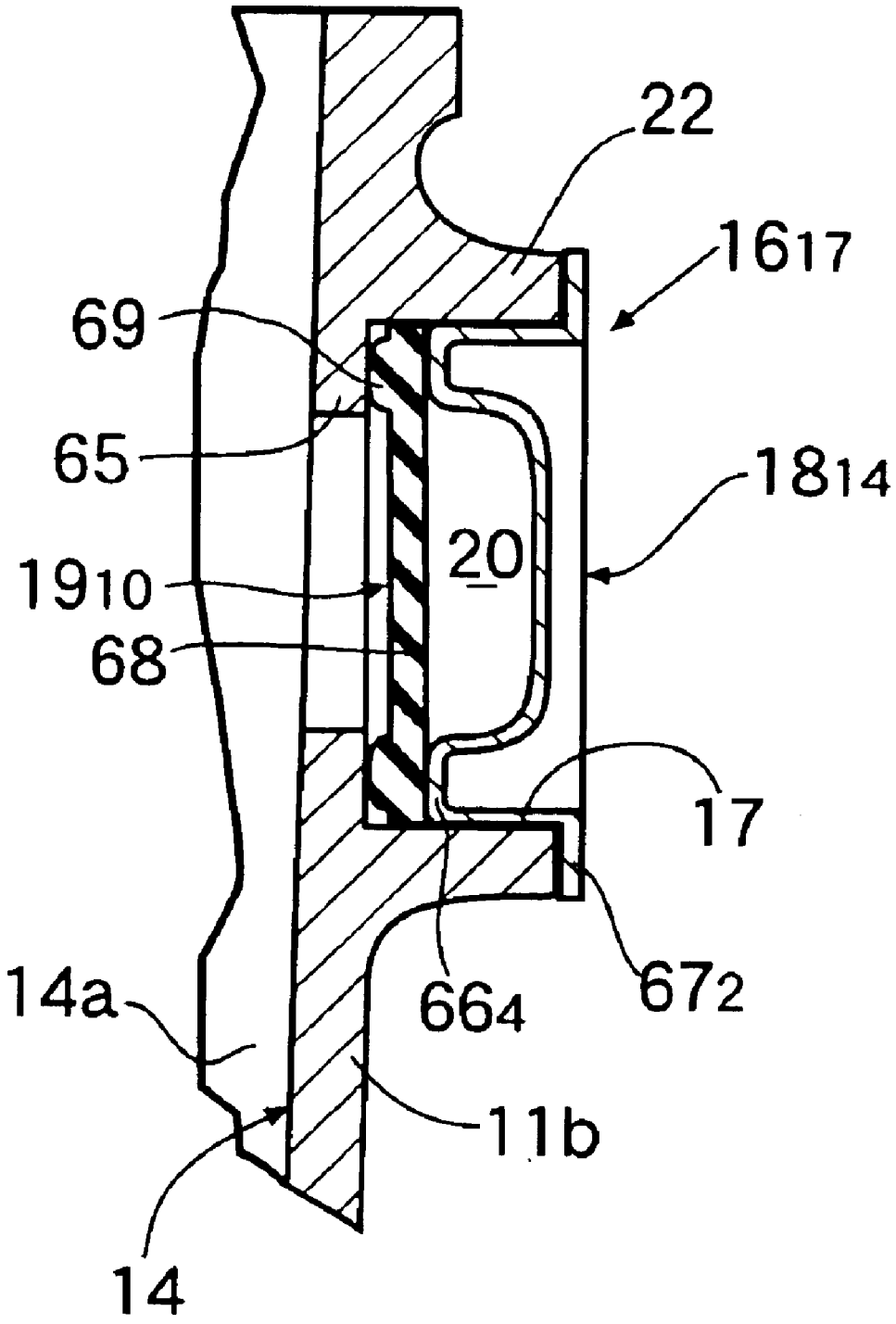
FIG. 24 a sectional view similar to FIG. 3, but according to an eighteenth embodiment of the present invention.

FIG. 24 shows an eighteenth embodiment of the present invention, wherein portions or components corresponding to those in each of the previous embodiments are designated by like reference characters.

The outer wall 11*b* is provided with a through-bore 17, and a receiving portion 65 which protrudes radially inwards from an inner surface of an inner end of the through-bore 17. A vibration absorbing means $16_{17}$ is mounted to the outer wall 11*b* to occlude the through-bore 17. The vibration absorbing means $16_{17}$ includes an occluding member $18_{14}$ for occluding the through-bore 17, and an elastic membrane $19_{10}$ clamped between the receiving portion 65 and the occluding member $18_{14}$ with one surface thereof facing the water passage portion 14*a* of the cooling water passage 14 and with the other surface thereof facing a space 20 defined between the elastic membrane $19_{10}$ and the occluding member $18_{14}$.

The occluding member $18_{14}$ is formed by pressing of a metal plate such as JIS SP or the like, and includes a cylindrical portion $66_4$ press-fitted into the through-bore 17, and a limiting collar $67_2$ protruding radially outwards from an outer end of the cylindrical portion $66_4$ to abut against the outer end of the boss portion 22.

According to the eighteenth embodiment, since the occluding member $18_{14}$ is formed by pressing the metal plate, the weight of the occluding member $18_{14}$ and thus the vibration absorbing means $16_{17}$ can be reduced. Thus, it is possible to avoid a variation in vibration mode on the surface of the cylinder block due to the mounting of the vibration absorbing means $16_{17}$ and to provide a sufficient piston slap sound reducing effect.

Figure 25:
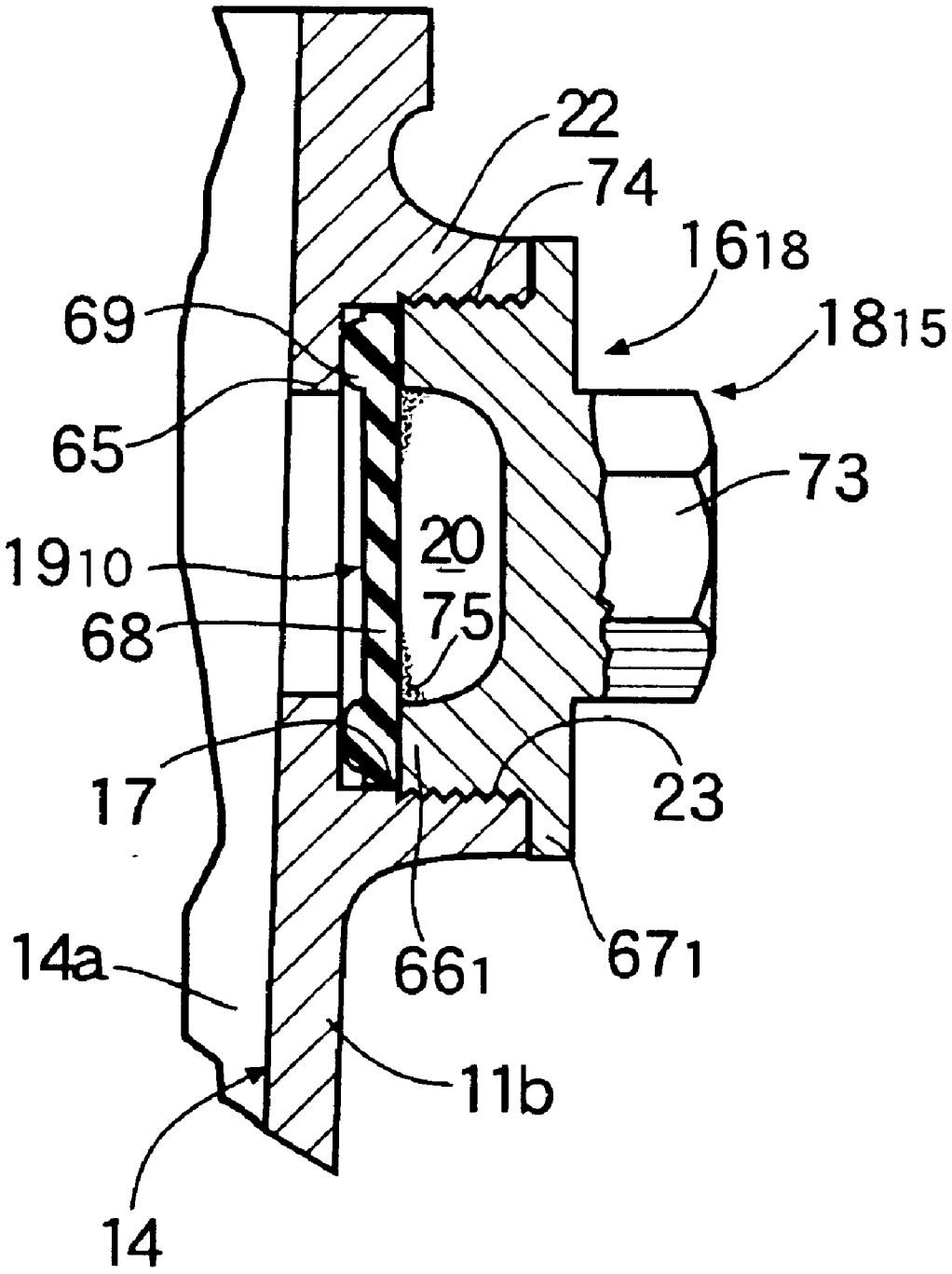
Figure 26:
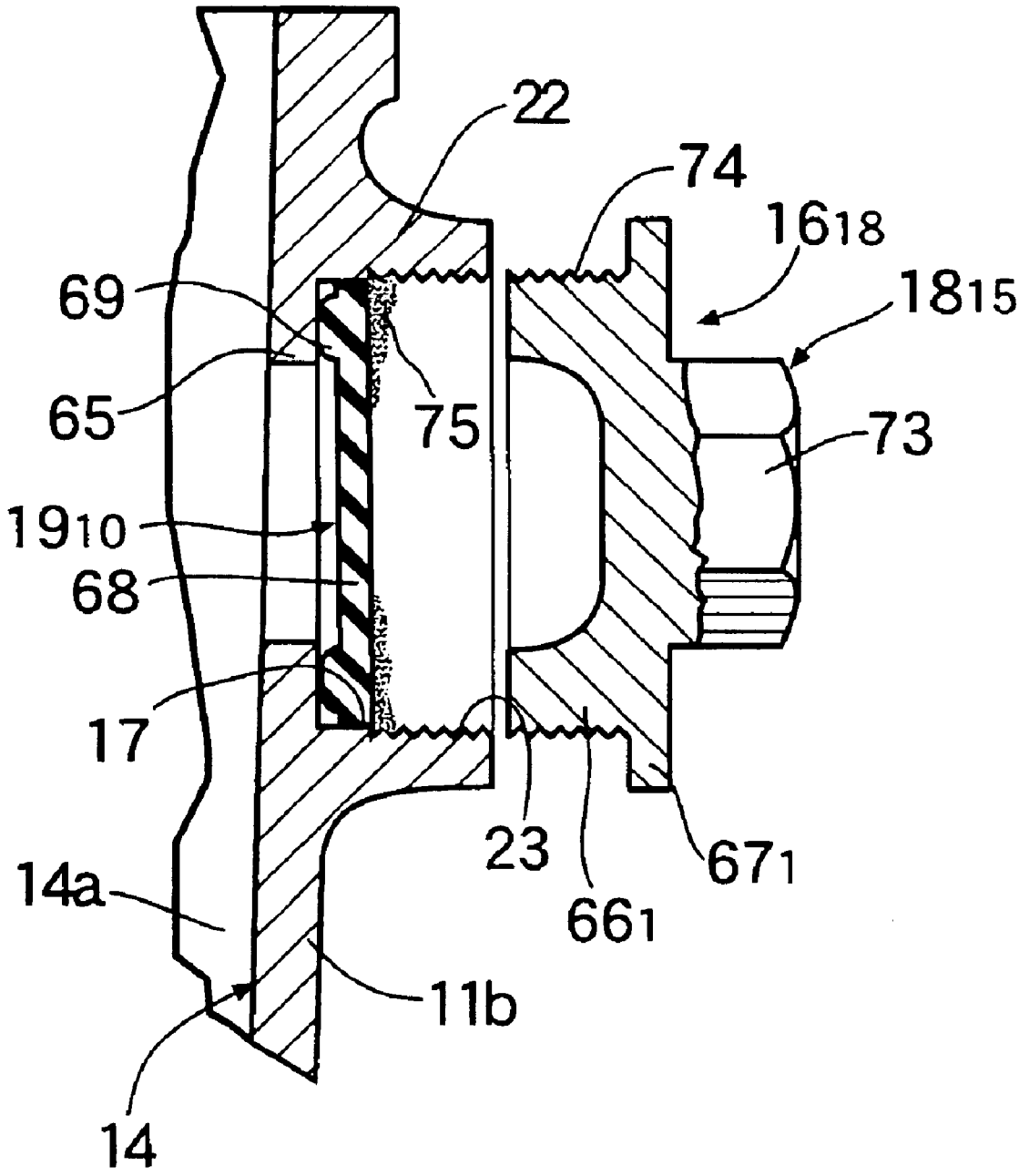

FIGS. 25 and 26 shows a nineteenth embodiment of the present invention. FIG. 25 is a vertical sectional view similar to FIG. 3, showing a vibration absorbing means, and FIG. 26 is a sectional view similar to FIG. 25, but in a state before mounting of an occluding member.

The outer wall 11*b* is provided with a through-bore 17, and a receiving portion 65 which protrudes radially inwards from an inner surface of an inner end of the through-bore 17. A vibration absorbing means $16_{18}$ is mounted to the outer wall 11*b* to occlude the through-bore 17. The vibration absorbing means $16_{18}$ includes an occluding member $18_{15}$ for occluding the through-bore 17, and an elastic membrane $19_{10}$ clamped between the receiving portion 65 and the occluding member $18_{15}$ with one surface thereof facing the water passage portion 14*a* of the cooling water passage 14 and with the other surface thereof facing a space 20 defined between the elastic membrane $19_{10}$ and the occluding member $18_{15}$.

Internal threads 23 are provided on an inner surface of the through-bore 17 to extend from a location outside the receiving portion 65 to an outer end of the through-bore 17.

The occluding member $18_{15}$ includes a cylindrical portion $66_1$ with its outer end closed, a limiting collar $67_1$ which protrudes radially outwards from the outer end of the cylindrical portion $66_1$ to abut against the outer end of the boss portion 22, and an engaging portion 73 which protrudes outwards from the outer end of the cylindrical portion $66_1$, so that a tool such as a spanner can be brought into engagement with the engaging portion 73, for example, it has a hexagonal cross section. External threads 74 are provided on an outer surface of the cylindrical portion $66_1$ and meshed with the internal threads 23 of the through-bore 17.

Namely, the occluding member $18_{15}$ is screwed into the through-bore 17 in such a manner that the external threads 74 are threadedly engaged with the internal threads 23, until the limiting collar $67_1$ abuts against the outer end of the boss portion 22. An outer periphery of the elastic membrane $19_{10}$ is clamped between a tip end of the cylindrical portion $66_1$ and the receiving portion 65 to form a space 20 between the elastic membrane $19_{10}$ and the occluding member $19_{10}$.

In order to prevent the tip end of the cylindrical portion $66_1$ from being brought into sliding contact with the outer periphery of the elastic membrane $19_{10}$ to damage the elastic membrane $19_{10}$ by turning the occluding member $18_{15}$, a grease 75 is previously applied to at least one of an outer surface of the outer periphery of the elastic membrane $19_{10}$ and the tip end of the cylindrical portion $66_1$, as shown in FIG. 26. Thus, the elastic membrane $19_{10}$ is prevented by the grease 75 from being damaged.

According to the nineteenth embodiment, since the occluding member $18_{15}$is screwed into the through-bore 17, the operation for mounting and removing the vibration absorbing means $16_{18}$ to and from the engine body E is facilitated.

although the embodiments of the present invention have been described in detail, it will be understood that the present invention is not limited to the above-described embodiments, and various modifications may be made without departing from the spirit and scope of the invention defined in claims.

For example, the present invention has been described as being applied to the water-cooled internal combustion engine, but present invention can be carried out as a device for reducing a vibration sound radiated from a passage defining structure which defines a liquid passage faced by at least a portion of a vibration generating section.

What is claimed is:

1. A vibration sound reducing device comprising a vibration absorbing means which is mounted to a passage defining structure defining a liquid passage faced by at least a portion of a vibration generating section, said vibration absorbing means absorbing the vibration transmitted from said vibration generating section through a liquid in said liquid passage, wherein said vibration absorbing means comprises an occluding member mounted to an outer wall of said passage defining structure so as to occlude a through-bore which is provided in the outer wall of said passage defining structure and opens at an inner end thereof into said liquid passage, an elastic membrane with one of opposite surfaces thereof facing said liquid passage and the other surface thereof facing a space defined between said elastic membrane and said occluding member, and a retaining member mounted to said occluding member for retaining said elastic membrane between said retaining member and said occluding member.

2. A vibration sound reducing device according to claim 1, wherein said occluding member has a cylindrical mounting portion projectingly provided at an inner end thereof; said elastic membrane includes an endless sealing portion which is in contact with a tip end face of said mounting portion, and a membrane portion formed at a thickness smaller than that of said sealing portion and integrally connected to an inner periphery of said sealing portion with a step formed therebetween; and said retaining member mounted to said occluding member with said sealing portion sandwiched between said retaining member and the tip end of said mounting portion is provided with a positioning portion which is engaged with the inner periphery of said sealing portion to position said elastic membrane in a plane perpendicular to an axis of said mounting portion.

3. A vibration sound reducing device according to claim 1, wherein said occluding member has a cylindrical mounting portion projectingly provided at an inner end thereof; said elastic membrane includes an endless sealing portion which is in contact with a tip end face of said mounting portion, and an annular lip portion protruding outwards from an outer periphery of said sealing portion; and said retaining member mounted to said occluding member with said sealing portion sandwiched between said retaining member and the tip end of said mounting portion is provided with a cylindrical portion which comes into contact with the outer periphery of the lip portion to position said elastic membrane in a plane perpendicular to an axis of said mounting portion.

4. A vibration sound reducing device according to claim 1, wherein said retaining member is press-fitted over the occluding member with an outer periphery of said elastic membrane sandwiched between said retaining member and said occluding member, and said occluding member is provided with a limiting portion for limiting an end of movement of said retaining member in a direction of press-fitting over said occluding member.

5. A vibration sound reducing device according to claim 1, wherein said occluding member is provided with an annular engage portion which is engaged with said elastic membrane over an entire periphery of the elastic membrane to position said elastic membrane in a plane perpendicular to an axis of said through-bore.

6. A vibration sound reducing device according to claim 1, wherein said vibration generating section is a cylinder portion which is provided in a cylinder block in a water-cooled internal combustion engine, said cylinder portion having a piston slidably received therein, and said passage defining structure is an engine body which includes the cylinder block and which is provided with (1) a cooling water passage defined as said liquid passage including a water passage portion surrounding said cylinder portion, and (2) said vibration absorbing means for absorbing the vibration transmitted from the cylinder portion through the cooling water in said cooling water passage.

7. A vibration sound reducing device comprising a vibration absorbing means which is mounted to a passage defining structure defining a liquid passage faced by at least a portion of a vibration generating section, said vibration absorbing means absorbing the vibration transmitted from said vibration generating section through a liquid in the liquid passage, wherein an outer wall of said passage defining structure is provided with a mounting bore which opens at an inner end thereof into said liquid passage, and said vibration absorbing means comprises an occluding member which is mounted to occlude said mounting bore and which includes a cylindrical support tube portion having external threads provided around an outer periphery thereof and threadedly engaged with internal threads provided on an inner surface of said mounting bore, and an elastic membrane mounted to an inner end of said occluding member with one of opposite surfaces thereof facing said liquid passage and the other surface thereof facing a space defined between said elastic membrane and said occluding member, said occluding member being provided with a recess which opens into an inner end of said occluding member to define said space, an axially extending portion of said recess being disposed in said support tube portion within an axial region where said external threads are disposed.

* * * * *